US009856847B2

(12) United States Patent
Sekiguchi

(10) Patent No.: US 9,856,847 B2
(45) Date of Patent: Jan. 2, 2018

(54) VEHICLE POWER SOURCE DEVICE

(71) Applicant: HONDA MOTOR CO., LTD., Tokyo (JP)

(72) Inventor: Satoshi Sekiguchi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/223,824

(22) Filed: Jul. 29, 2016

(65) Prior Publication Data

US 2017/0030316 A1 Feb. 2, 2017

(30) Foreign Application Priority Data

Jul. 31, 2015 (JP) ..... 2015-152198

(51) Int. Cl.
*F02N 11/08* (2006.01)
*F02N 11/04* (2006.01)

(52) U.S. Cl.
CPC ..... *F02N 11/0866* (2013.01); *F02N 11/04* (2013.01); *F02N 11/0822* (2013.01);
(Continued)

(58) Field of Classification Search
CPC .. F02N 11/04; F02N 11/0803; F02N 11/0814; F02N 11/0822; F02N 11/0848;
(Continued)

(56) References Cited

U.S. PATENT DOCUMENTS 5,155,373 A * 10/1992 Tsuchiya ..... F02N 11/0866 123/179.1
2007/0032915 A1* 2/2007 Yamaguchi ..... H02J 7/1423 701/1

(Continued)

FOREIGN PATENT DOCUMENTS

JP 2014-177213 A 9/2014
JP 2015-9790 A 1/2015

OTHER PUBLICATIONS

Office Action dated Jan. 31, 2017, issued in counterpart Japanese Application No. 2015-152198. (4 pages).

(Continued)

*Primary Examiner* — John Kwon
*Assistant Examiner* — Johnny H Hoang
(74) *Attorney, Agent, or Firm* — Westerman, Hattori, Daniels & Adrian, LLP

(57) ABSTRACT

A vehicle power source device includes a first group that includes a first battery and a first load group which is connected with the first battery, a second group that includes a second battery or includes the second battery and a second load group which is connected with the second battery, a third group that includes a starting device which starts an internal combustion engine and a capacitor, a first switch that is provided between the first group and the second group, a second switch that is provided between the second group and the third group, a third switch that is provided between the first group and the third group, and a control unit that performs control to turn the first switch off, the second switch off, and the third switch on in a case where the internal combustion engine is started.

14 Claims, 27 Drawing Sheets

(52) U.S. Cl.
CPC ..... *F02N 2011/0885* (2013.01); *F02N 2200/0801* (2013.01); *F02N 2200/101* (2013.01); *F02N 2200/102* (2013.01)

(58) Field of Classification Search
CPC ..... F02N 11/10; F02N 2011/0885; F02N 2200/101; F02N 2200/102; F02N 2200/0801
USPC ..... 701/36, 110–113; 123/179.1, 179.2, 123/179.4, 196 S, 198 D
See application file for complete search history.

(56) References Cited

U.S. PATENT DOCUMENTS

2011/0227540 A1* 9/2011 Kanoh ..... H02J 7/345 320/135
2013/0320931 A1* 12/2013 Yoshida ..... B60R 16/033 320/135
2014/0265558 A1* 9/2014 Katayama ..... B60R 16/033 307/10.1
2015/0012175 A1* 1/2015 Hara ..... B60R 16/03 701/36
2015/0053164 A1* 2/2015 Hansen ..... F02N 11/0803 123/179.4
2015/0134231 A1* 5/2015 Li ..... F02N 11/0814 701/112
2015/0370216 A1* 12/2015 Okada ..... G03G 15/2039 399/88
2016/0153418 A1* 6/2016 Shibachi ..... F02N 11/0866 290/36 R

OTHER PUBLICATIONS

Office Action dated Aug. 1, 2017, issued in counterpart Japanese Application No. 2015-152198, with English translation (8 pages).

* cited by examiner

FIG. 19

| VEHICLE STATE | SW1A | SW1B | SW2 | SW3 | SW4 | SW5 | SW6 |
|---|---|---|---|---|---|---|---|
| IGNITION SWITCH HAS BEEN TURNED OFF | ON | OFF | OFF | OFF | OFF | OFF | OFF |
| IGNITION SWITCH TURNED ON (NOT YET CHARGED) | ON | ON | ON | OFF | ON | OFF | ON |
| INITIAL STARTING | OFF | OFF | OFF | ON | ON | ON | OFF |
| REGENERATING | ON | ON | ON | OFF | ON | ON | OFF |
| IDLING STOPPED OR IGNITION SWITCH TURNED OFF AFTER TRAVEL | ON | ON | ON | OFF | ON | ON | OFF |
| RETURN TO IDLING | ON | ON | OFF | OFF | ON | ON | OFF |
| ABNORMALITY OF CAPACITOR | ON | ON | ON | OFF | ON | OFF | OFF |
| ABNORMALITY OF SECOND BATTERY | ON | ON | ON | OFF | OFF | ON | OFF |
| JUMP STARTING | ON | OFF | OFF | OFF | OFF | OFF | OFF |
| ABNORMALITY OF FIRST BATTERY | ON | OFF | OFF | OFF | OFF | OFF | OFF |

FIG. 27

| VEHICLE STATE | SW21 | SW22A | SW22B | SW23 | SW24 |
|---|---|---|---|---|---|
| IGNITION SWITCH HAS BEEN TURNED OFF | OFF | OFF | OFF | OFF | OFF |
| IGNITION SWITCH TURNED ON (NOT YET CHARGED) | ON | OFF | ON | OFF | ON |
| INITIAL STARTING | OFF | OFF | OFF | ON | OFF |
| REGENERATING | ON | ON | OFF | OFF | ON |
| IDLING STOPPED OR IGNITION SWITCH TURNED OFF AFTER TRAVEL | ON | ON | OFF | OFF | ON |
| RETURN TO IDLING | ON | OFF | OFF | OFF | ON |

VEHICLE POWER SOURCE DEVICE

CROSS REFERENCES TO RELATED APPLICATIONS

The present, application claims priority under 35 U.S.C. §119 to Japanese Patent Application No. 2015-152198, filed Jul. 31, 2015, entitled "Vehicle Rower Source Device." The contents of this application are incorporated herein by reference in their entirety.

BACKGROUND

1. Field

The present disclosure relates to a vehicle power source device.

2. Description of the Related Art

In related art, a vehicle power source device has been known in which a main battery connected with an electrical load is connected with a sub battery connected with a generator and which includes a switch between the main battery and the sub battery (see, for example, Japanese Unexamined Patent Application Publication No. 2015-9790).

SUMMARY

Incidentally, the vehicle power source device in the above related art may not perform appropriate power control when an internal combustion engine is started.

It is desirable to provide a vehicle power source device that may perform appropriate power control when an internal combustion engine is started.

A first aspect of the present disclosure provides a vehicle power source device including the following electrical circuit and electrical components therein: a first group that includes a first battery and a first load group which is connected with the first battery; a second group that includes a second battery or includes the second battery and a second load group which is connected with the second battery; a third group that includes a starting device which starts an internal combustion engine and a capacitor; a first switch that is provided between the first group and the second group; a second switch that is provided between the second group and the third group; a third switch that is provided between the first group and the third group; and a control unit (a controller) that performs control to turn the first switch off, the second switch off, and the third switch on in a case where the internal combustion engine is started.

A second aspect of the present disclosure provides the vehicle power source device according to the first aspect, in which the second load group may be a processor that controls an in-vehicle apparatus which requests long time for starting compared to the first load group or an in-vehicle apparatus which is related to an operation of a vehicle.

A third aspect of the present disclosure provides the vehicle power source device according to the first or second aspect, which may further include: a fourth switch that is provided between the second battery and the second load group; and a fifth switch that is provided between the capacitor and the starting device, and in which the control unit may perform control to turn the first switch on, the second switch off, the third switch off, the fourth switch on, and the fifth switch on in a return from an idle reduction state where the internal combustion engine is temporarily stopped and the internal combustion engine is restarted in accordance with a set condition.

A fourth aspect of the present disclosure provides the vehicle power source device according to the third aspect, in which the control unit may perform control to turn the first switch on, the second switch on, the third switch off, the fourth switch on, and the fifth switch on in the idle reduction state of a vehicle.

A fifth aspect of the present disclosure provides the vehicle power source device according to the third or fourth aspect, in which the control unit may perform control to turn the first switch on, the second switch on, the third switch off, the fourth switch on, and the fifth switch on in a case where regenerative power is output from a generator.

A sixth aspect of the present disclosure provides the vehicle power source device according to any one of the third to fifth aspects, in which the control unit may perform control to turn the first switch on, the second switch on, the third switch off, the fourth switch on, and the fifth switch on in a case where an ignition switch that outputs a signal which demands start or stop of the internal combustion engine outputs a signal that demands stop.

A seventh aspect of the present disclosure provides the vehicle power source device according to any one of the third to sixth aspects, in which the control unit may perform control to turn the first switch on, the second switch on, the third switch off, the fourth switch on, and the fifth switch off in a case where the capacitor is charged.

An eighth aspect of the present disclosure provides the vehicle power source device according to any one of the third to seventh aspects, in which the control unit may perform control to turn the first switch on, the second switch on, the third switch off, the fourth switch on, and the fifth switch off in a case where abnormality of the capacitor is detected.

A ninth aspect of the present disclosure provides the vehicle power source device according to any one of the third to eighth aspects, in which the control unit may perform control to turn the first switch on, the second switch on, the third switch off, the fourth switch off, and the fifth switch on in a case where abnormality of the second battery is detected.

A tenth aspect of the present disclosure provides the vehicle power source device according to the first or second aspect, which may further include a fourth switch that is provided between the second battery and the first and second switches and in which the control unit may perform control to turn the first switch on, the second switch off, the third switch off, and the fourth switch on in a return from an idle reduction state where the internal combustion engine is temporarily stopped and the internal combustion engine is restarted in accordance with a set condition.

An eleventh aspect of the present disclosure provides the vehicle power source device according to the first, second, or tenth aspect, in which the control unit may perform control to turn the first switch on, the second switch on, the third switch off, and the fourth switch on in the idle reduction state of a vehicle.

A twelfth aspect of the present disclosure provides the vehicle power source device according to the first, second, tenth, or eleventh aspect, in which the control unit may perform control to turn the first switch on, the second switch on, the third switch off, and the fourth switch on in a case where regenerative power is output from a generator.

A thirteenth aspect of the present disclosure provides the vehicle power source device according to any one of the first, second, and tenth to twelfth aspects, in which the control unit may perform control to turn the first switch on, the second switch on, the third switch off, and the fourth switch on in a case where an ignition switch that outputs a signal which demands start or stop of the internal combustion engine outputs a signal that demands stop.

A fourteenth aspect of the present disclosure provides the vehicle power source device according to any one of the first, second, and tenth to thirteenth aspects, in which the control unit may perforin control to turn the first switch on, the second switch on, and the third switch off in a case where the capacitor is charged.

In the first, second, seventh, and fourteenth aspects of the present disclosure, the control unit performs control to turn the first switch off, the second switch off, and the third switch on in a case where the internal combustion engine is started, and appropriate power control may thereby be performed in the case where the internal combustion engine is started.

In the third and tenth aspects of the present disclosure, the starting device is started by using only the capacitor in the return from the idle reduction state, the current is supplied from the first battery and the second battery to the load groups, and voltage fluctuations that occur to the load groups in starting the starting device may thereby be reduced.

In the fourth and eleventh aspects of the present disclosure, because the electric potential of the second battery is higher than the electric potential of the first battery in the idle reduction state of the vehicle, discharge may be performed from the second battery, and discharge from the first battery may be reduced.

In the fifth and twelfth aspects of the present disclosure, regenerative power may be supplied to the first battery, the first load groups, the second battery, the second load groups, and the capacitor.

In the sixth and thirteenth aspects of the present disclosure, the current is supplied from the second battery to the first battery in the case where the ignition switch that outputs the signal which demands start or stop of the internal combustion engine outputs the signal that demands stop, and discharge from the first battery may thereby be reduced.

In the eighth aspect of the present disclosure, even in a case where abnormality of the capacitor is detected, the current may appropriately be supplied from the first battery or the second battery to the load groups or the starting device.

In the ninth aspect of the present disclosure, in a case where abnormality of the second battery is detected, the current may appropriately be supplied from the first battery or the capacitor to the load groups or the starting device.

BRIEF DESCRIPTION OF THE DRAWINGS

FIG. 19 illustrates one example of the relationship between vehicle states and control of switches.

FIG. 22 is a diagram that illustrates a current flow in a case where the starting device is started after the ignition switch is turned on.

FIG. 27 illustrates one example of the relationship between vehicle states and control of switches.

DESCRIPTION OF THE PREFERRED EMBODIMENTS

Embodiments of a vehicle power source device of the present disclosure will hereinafter be described with reference to drawings.

First Embodiment

Figure 1:
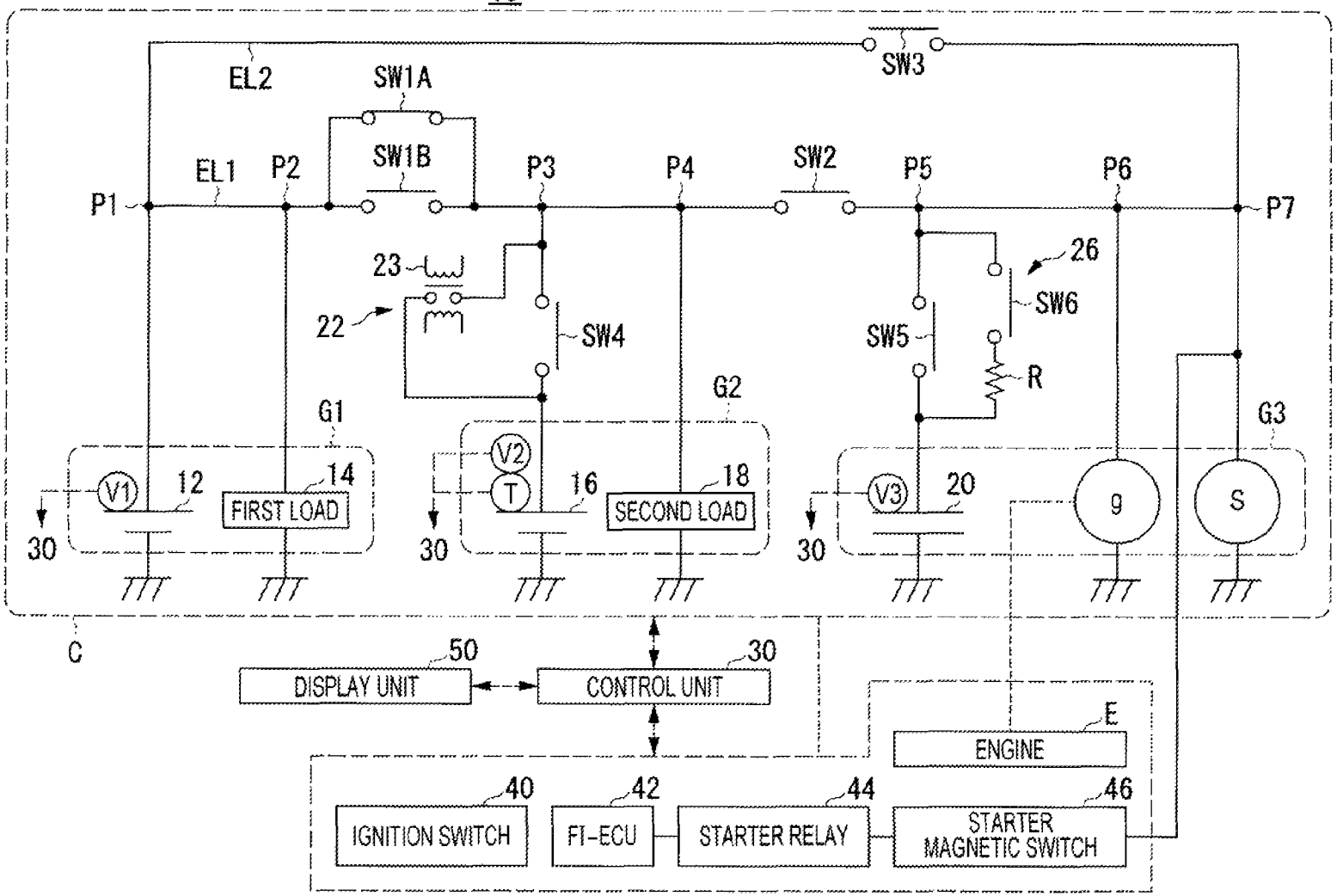
FIG. 1 is a configuration diagram of a vehicle power source device.

FIG. 1 is a configuration diagram of a vehicle power source device 10. The vehicle power source device 10 is installed in a vehicle, for example. The vehicle power source device 10 includes a circuit C, a control unit 30, an internal combustion engine (engine E), an ignition switch 40, an FI-electronic control unit (ECU) 42, a starter relay 44, a starter magnetic: switch 46, and a display unit 50, for example. The circuit C of the vehicle power source device 10 includes a first battery 12, a first load 14, a second battery 16, a second load 18, a starting device S, a generator g, a capacitor 20, a latch circuit 22, switches SW1A to SW4, a precharge circuit 26, sensors V1 to V3, and a sensor T, for example.

The circuit C of the vehicle power source device 10 includes a loop electric line that is formed with a first electric line EL1 and a second electric line EL2. The first electric line EL1 is connected with the first battery 12, the first load 14, the second battery 16, the second load 18, the starting device S, the generator g, the latch circuit 22, the capacitor 20, the switches SW1A to SW4, and the precharge circuit 26.

(First Group)

The first battery 12 is connected to a vicinity of a joining point P1 between the first electric line EL1 and the second electric line EL2, for example. The first battery 12 is a lead battery or the like, for which a prescribed voltage (12 V or the like) is set as a rated voltage, for example.

The first load 14 is connected with a joining point P2 between the joining point P1 and the switches SW1A and SW1B, for example. The first load 14 is an in-vehicle apparatus, such as an air conditioner, a rear window defogger, or a seat heater provided in the vehicle, which does not request relatively long time for start or return of a power source. The first battery 12 and the first load 14 are included in a first group G1.

The sensor V1 detects a voltage value of the first battery 12 and outputs the detected voltage value to the control unit 30, for example. Further, the vehicle power source device 10 may include, in addition to or instead of the sensor V1, a sensor that detects the temperature of the first battery 12 and outputs the detected temperature to the control unit 30.

(Second Group)

The second battery 16 is connected with a joining point P3 between the switches SW1A and SW1B and the switch SW2, for example. The second battery 16 is a battery whose receiving rate of charge is high compared to the first battery 12. The second battery 16 is a secondary cell such as a lithium-ion battery or a lithium-ion polymer battery.

Similarly to the joining point P3, the second load 18 is connected with a joining point P4 between the switches SW1A and SW1B and the switch SW2, for example. The second load 18 is an in-vehicle apparatus, such as a navigation device provided in the vehicle, which requests long time for start or return of the power source compared to the first load 14. The second load 18 is an in-vehicle apparatus such as a central processing unit (CPU) related to the vehicle operation, such as an ECU that controls an electric steering device or an ECU that controls an electric brake device, for example. The second battery 16 and the second load 18 are included in a second group G2.

The sensor V2 detects the voltage of the second battery 16 and outputs a detected voltage value to the control unit 30, for example. The sensor T detects the temperature of the second battery 16 and outputs the detected temperature to the control unit 30, for example.

(Third Group)

The starting device (starter motor) S is connected with a joining point P7 between the switch SW2 and the switch SW3, for example. The starting device S has a gear mechanism (not illustrated) that is connected with a crankshaft (not illustrated) of the internal combustion engine, for example, and starts the internal combustion engine by driving the gear mechanism to forcibly rotate the crankshaft of the internal combustion engine.

The generator g is connected to a vicinity of a joining point P6 between the switch SW2 and the switch SW3, for example. The generator g is an alternating current generator that is coupled with the crankshaft of the internal combustion engine via a belt or the like. The generator g generates power by motive power in an operation of the internal combustion engine and thereby outputs the generated power. Further, the generator g converts the kinetic energy of a vehicle body, which is transmitted from a driving wheel (not illustrated) of the vehicle in deceleration or the like of the vehicle, into electrical energy (regenerative energy) and thereby outputs regenerative power. The generator g includes a rectifier (not illustrated) or the like, which rectifies an alternating current output by generation or regeneration into a direct current output. The generator g may be a generator with a start (starter) function, the generator having a function of the starting device S.

The capacitor 20 is connected to a vicinity of a joining point P5 between the switch SW2 and the switch SW3, for example. The capacitor 20 is an electric double-layer capacitor, an electrolytic capacitor, a lithium-ion capacitor, or the like, for example. The starting device S, the generator g, and the capacitor 20 are included in a third group G3.

The sensor V3 detects a voltage value of the capacitor 20 and outputs the detected voltage value to the control unit 30, for example. Further, the vehicle power source device 10 may include, in addition to or instead of the sensor V3, a sensor that detects the temperature of the capacitor 20 and outputs the detected temperature to the control unit 30.

(Switches SW)

The switch SW1A and the switch SW1B are examples of a first switch. An ON state of the first switch means that either switch of the switch SW1A and the switch SW1B is in the ON (conducting) state. The switch SW1A and the switch SW1B are connected between the first group G1 and the second group G2 of the first electric line EL1, for example. The switch SW1A and the switch SW1B are connected with each other in parallel. The switch SW1A is a contact point such as an electromagnetic contactor, for example. A switch used for the switch SW1A is a normally closed contact point. A normally closed contact point is a contact point that maintains the ON (conducting) state in a case where a current does not flow through the switch and maintains an OFF (breaking) state in a case where a current flows through the switch. The switch SW1B is a contact point such as an electromagnetic contactor, for example. A normally open contact point is a contact point that maintains the ON state in a case where a current flows through the switch and maintains the OFF state in a case where a current does not flow through the switch. The switch SW3 is provided on the second electric line EL2, for example.

The switch SW2 is one example of a second switch. The switch SW2 is connected between the second group G2 and the third group G3 of the first electric line EL1, for example. The switch SW2 is a contact point such as an electromagnetic contactor, for example, and is a normally open contact point.

The switch SW3 is one example of a third switch. The switch SW3 is connected between the first group G1 and the third group G3 of the second electric line EL2, for example. The switch SW3 is a contact point such as an electromagnetic contactor, for example, and is a normally open contact point. Further, the switch SW3 is a contact point with a large capacity compared to the other switches SW1A to SW2 and switches SW4 to SW6, for example.

The switch SW4 is one example of a fourth switch. The switch SW4 is provided between the joining point P3 and the second battery 16. The switch SW4 is a contact point such as an electromagnetic: contactor, for example, and is a normally open contact point. Further, a latch circuit 22 that includes the latching relay 23 is connected in parallel with the switch SW4. Details of the latch circuit 22 will be described later.

The switch SW5 is one example of a fifth switch. The switch SW5 is provided between the joining point P5 and the capacitor 20, The switch SW5 is a contact point such as an electromagnetic contactor, for example, and is a normally open contact point. Further, the precharge circuit 26 is connected in parallel with the switch SW5. The precharge circuit 26 is a circuit in which the switch SW6 and a resistor R are connected together in series. The switch SW6 is a contact point such as an electromagnetic contactor, for example, and is a normally open contact point. The resistor R has a higher resistance value than the resistance value of the capacitor 20.

(Other Apparatuses and so Forth)

The control unit 30 is a processor such as a central processing unit (CPU), for example. The control unit 30 controls the switch SW1A to the switch SW6 and the display unit 50. Details of processes executed by the control unit 30 will be described later.

The internal combustion engine is a motive power source such as the engine E, a diesel engine, or a gasoline engine. The FI-ECU 42 is an ECU that is configured with an electronic circuit such as a CPU, for example, and performs various kinds of control related to the operation of the engine E such as fuel supply and ignition timing. An FI-ECU 42 controls start and stop of the engine E in accordance with signals of a start request and a stop request that are output from the ignition switch 40 in response to an operation by a driver.

The FI-ECU 42 controls idle reduction of the engine E. In the idle reduction, the engine E in an operating state is automatically and temporarily stopped in response to satisfaction of prescribed temporary stop conditions, and the engine E in the temporary stop state is automatically restarted in response to satisfaction of set return conditions. Set temporary stop conditions are that the vehicle speed of the vehicle is zero, that the accelerator pedal opening is zero, that a brake pedal switch is turned on, and so forth, for example. The set return conditions are that the brake pedal switch is turned off, that the accelerator pedal opening is more than or equal to a reference, and so forth, for example.

The FI-ECU 42 starts the engine E by performing control to make the starter relay 44 the ON state in response to the start request or a return request from the temporary stop state of the idle reduction in accordance with signals output from the ignition switch 40. The FI-ECU 42 controls the generation operation of the generator g and arbitrarily changes a generation voltage of the generator g.

The starter magnetic: switch 46 switches between feeding power and not feeding power to the starting device S in accordance with the ON or OFF state of the starter relay 44. The ON or OFF state of the starter relay 44 is controlled by the FI-ECU 42.

The display unit 50 is a liquid crystal display (LCD), an organic electroluminescence (EL) display device, or the like. The display unit 50 displays information that indicates abnormality of the first battery 12 and the second battery 16 based on the control by the control unit 30.

The first battery 12, the first load 14, the second battery 16, the second load 18, the capacitor 20, the generator g, and the starting device S are connected with vehicle body members and so forth. Further, the second battery 16, the switch SW1A, the switch SW1B, the capacitor 20, and the precharge circuit 26 may be an integrally packaged unit.

[Charge and Discharge Operations]

The vehicle power source device 10 according to this embodiment includes the above configuration. Operations of the vehicle power source device 10 will next be described. Charge and discharge operations of the first battery 12, the second battery 16, and the capacitor 20 will be described below.

(OFF State of Ignition Switch 40)

The OFF state of the ignition switch 40 is a state prior to a start of an electrical load such as the starting device S that is necessary for starting the engine E. A dark current is discharged from the first battery 12 in the state where the ignition switch 40 is turned off, for example. The dark current flows to the first load 14 and the second load 18 via the switch SW1A.

For example, in a case where the switch SW4 is not provided or a case where the switch SW4 is in the ON state, whether or not the dark current from the second battery 16 is discharged has to be monitored, and the dark current has to be blocked when the dark current is discharged from the second battery 16. In this case, the control unit 30 has to be started. In a case where the control unit 30 is started, the dark current discharged from the second battery 16 increases, and the fuel efficiency of the second battery 16 may degrades, or deterioration thereof may progress.

Figure 2:
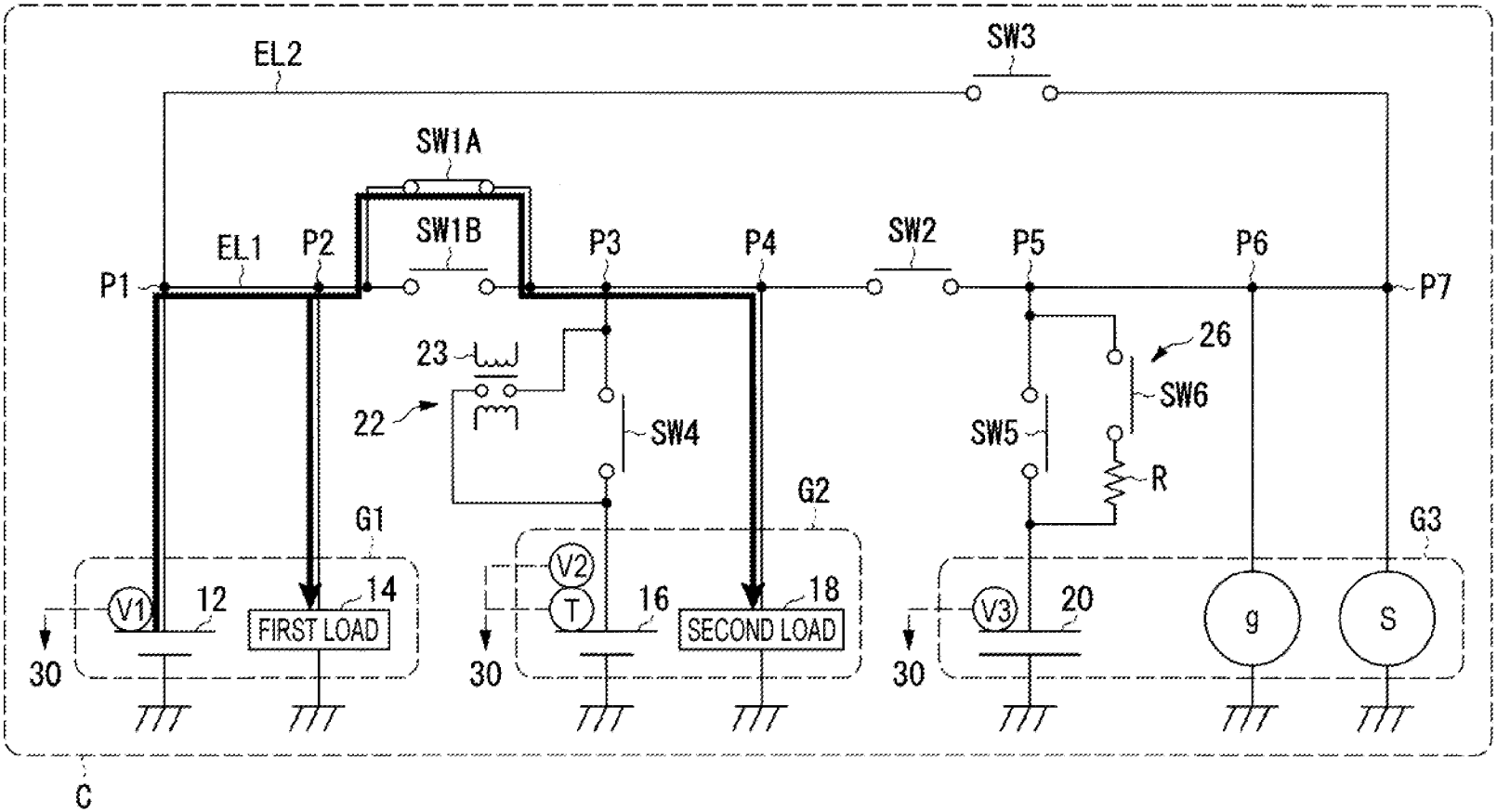
FIG. 2 is a diagram that illustrates a situation where a dark current is discharged from a first battery.

However, because the vehicle power source device 10 of this embodiment has the switch SW4 in an open state, the discharge of the dark current from the second battery 16 may be blocked. FIG. 2 is a diagram that illustrates a situation where the dark current is discharged from the first battery 12. Accordingly, the vehicle power source device 10 may reduce degradation of the fuel efficiency of the second battery 16 and the progress of deterioration thereof.

(Process of Turning Ignition Switch 40 on)

Figure 3:
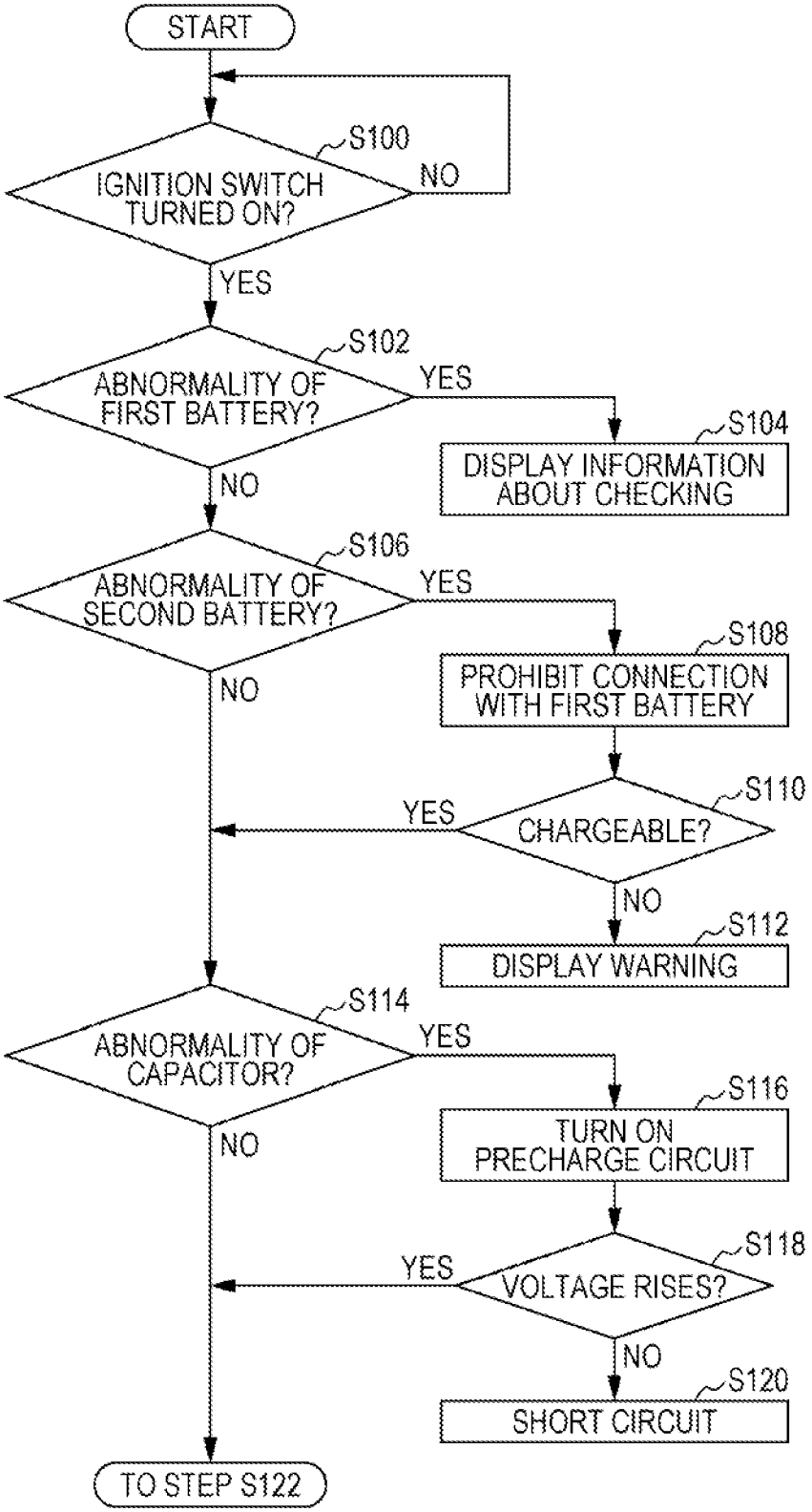
FIG. 3 is a flowchart that illustrates a flow of a process executed by turning on an ignition switch.

FIG. 3 is a flowchart that illustrates a flow of a process executed by turning on the ignition switch 40. The ON state of the ignition switch 40 is a state where an electrical load such as the starting device S that is necessary for starting the engine E is started.

The control unit 30 first waits until the ignition switch 40 is made the ON state (step S100). In a case where the ignition switch 40 is made the ON state, the control unit 30 determines whether or not the first battery 12 has abnormality (step S102). The control unit 30 determines whether or not the first battery 12 has a prescribed voltage (12.4 V) or higher and lower than a prescribed voltage (16 V), for example. In a case where the above condition is not satisfied, the control unit 30 determines that the first battery 12 has abnormality. In a case where the control unit 30 determines that the first battery 12 has abnormality in step S102, the control unit 30 causes the display unit 50 to display information that indicates that checking the first battery 12 is advisable (step S104).

In a case where the control unit 30 determines that the first battery 12 has no abnormality, the control unit 30 determines whether or not the second battery 16 has abnormality (step S106). The control unit 30 determines that the second battery 16 has abnormality in a case where the temperature of the second battery 16 is −30 degrees or higher and is not +55 degrees or lower, for example.

In a case where the control unit 30 determines that the second battery 16 has no abnormality, the control unit 30 moves the process to step S114, In a case where the control unit 30 determines that the second battery 16 has abnormality, the control unit 30 prohibits the connection between the first battery 12 and the second battery 16 (step S108), for example, and determines whether or not the second battery 16 is chargeable (step S110). The control unit 30 determines whether or not the capacity of the second battery 16 is less than a reference value, for example. In a case where the control unit 30 determines that the capacity is less than the reference value, the control unit 30 determines that the second battery 16 is chargeable.

In a case where the control unit 30 determines that the second battery 16 is chargeable, the control unit 30 moves the process to step S114. In a case where the control unit 30 determines that the second battery 16 is not chargeable, the control unit 30 causes the display unit 50 to display warning information that indicates that the second battery 16 has abnormality (step S112).

The control unit 30 determines whether or not the capacitor 20 has abnormality (step S114). For example, the control unit 30 determines whether or not the voltage of the capacitor 20 is a reference voltage (for example, 1 V) or lower. In a case where the control unit 30 determines that the capacitor 20 has no abnormality, the control unit 30 moves the process to step S122.

Figure 4:
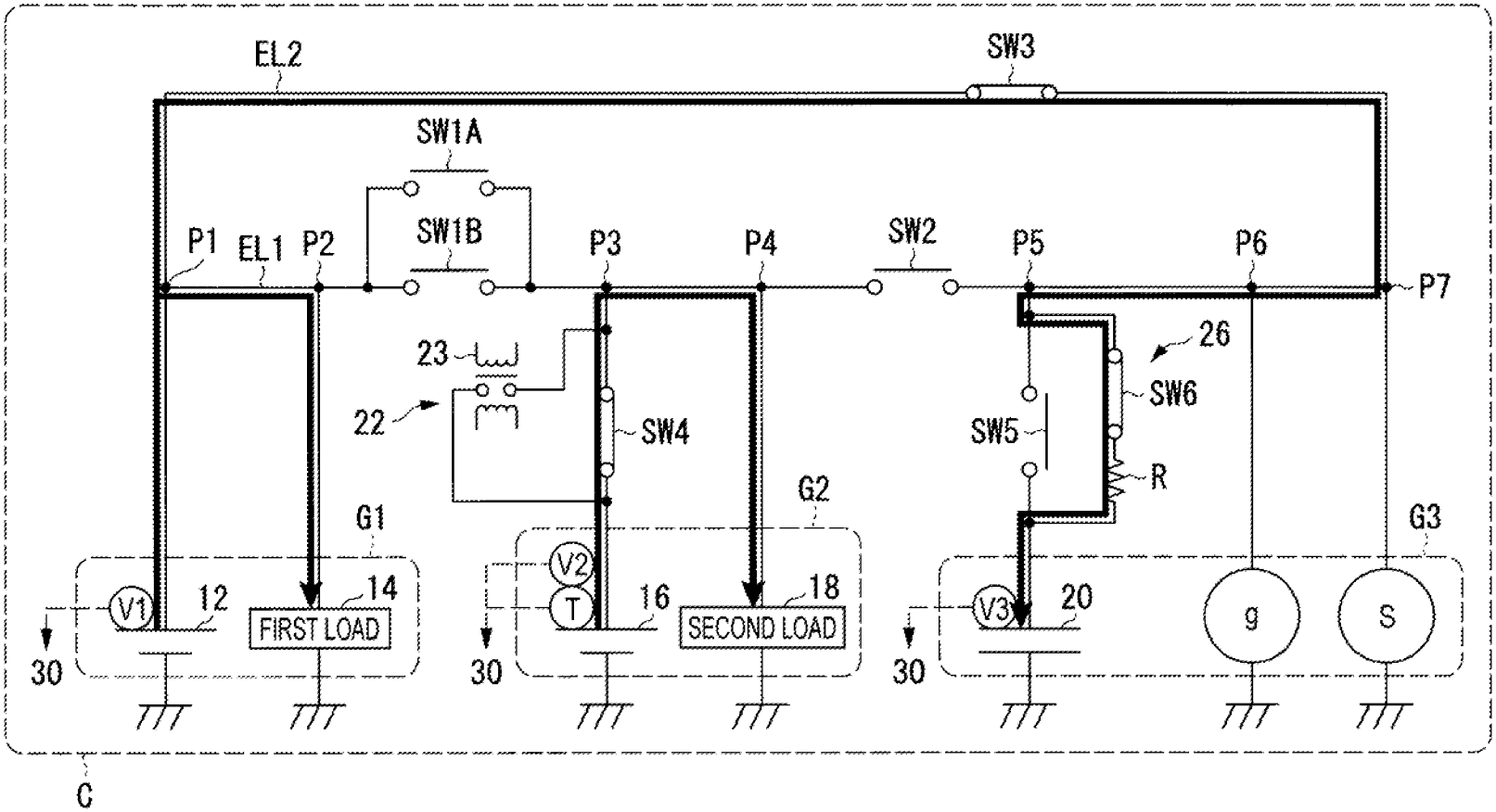
FIG. 4 is a diagram that Illustrates a situation where a capacitor is charged.

In a case where the control unit 30 determines that the capacitor 20 has abnormality, the control unit 30 performs control to make the switch SW1A, the switch SW1B, the switch SW2, and the switch SW5 the OFF state, performs control to make the switch SW3, the switch SW4, and the switch SW6 the ON state, and thereby makes the precharge circuit 26 the ON state (step S116). Accordingly, the capacitor 20 is charged by the current discharged from the first battery 12. FIG. 4 is a diagram that illustrates a situation where the capacitor 20 is charged. Because the capacitor 20 has a low resistance, a large current flows into the capacitor 20 in a case where the electric potential difference between the capacitor 20 and the first battery 12 is large. The precharge circuit 26 is provided with the resistor R with a higher resistance than the capacitor 20 and may thus reduce a rapid voltage drop and deterioration of the first battery 12. Further, damage to the switches and so forth that are connected with the circuit C of the vehicle power source device 10 may be reduced. Further, the control unit 30 performs control to make the switch SW3 the ON state, charges the capacitor 20 by the current output from the first battery 12, and may thereby quickly determines whether the capacity of the capacitor 20 is zero or short circuit occurs in the circuit C, as described later.

The control unit 30 may confirm initial states of the first load 14, the second load 18, the starting device S, and the generator g, for example, before performing control to make the precharge circuit 26 the ON state. In a case where the initial states are not normal, the control unit 30 may restrict starts of the loads or apparatuses that are not normal or may control the travel of the vehicle.

The control unit 30 next determines whether or not the voltage of the capacitor 20 rises (step S118). In a case where the control unit 30 determines that the voltage of the capacitor 20 does not rise, the control unit 30 determines that the capacitor 20 has abnormality (for example, short circuit has occurred) (step S120). In this case, the control unit 30 causes the display unit 50 to display information that indicates that the capacitor 20 has abnormality, for example. In a case where the control unit 30 determines that the voltage of the capacitor 20 rises, the control unit 30 determines that the capacitor 20 has no abnormality (for example, no short circuit has occurred) and moves the process to step S122.

Figure 5:
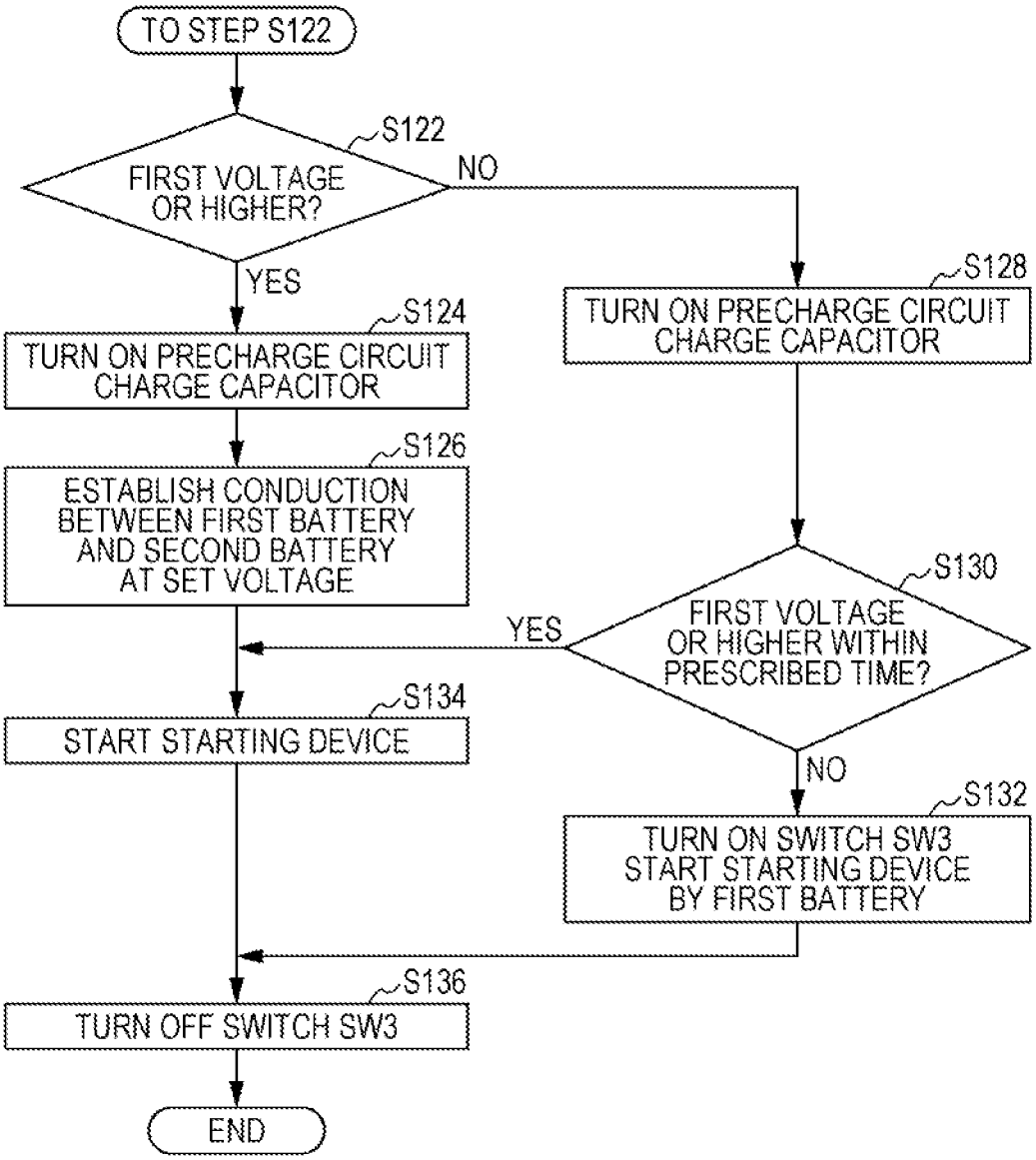
FIG. 5 is a flowchart that illustrates a process from step S122, which is executed by turning on the ignition switch.
Figure 6:
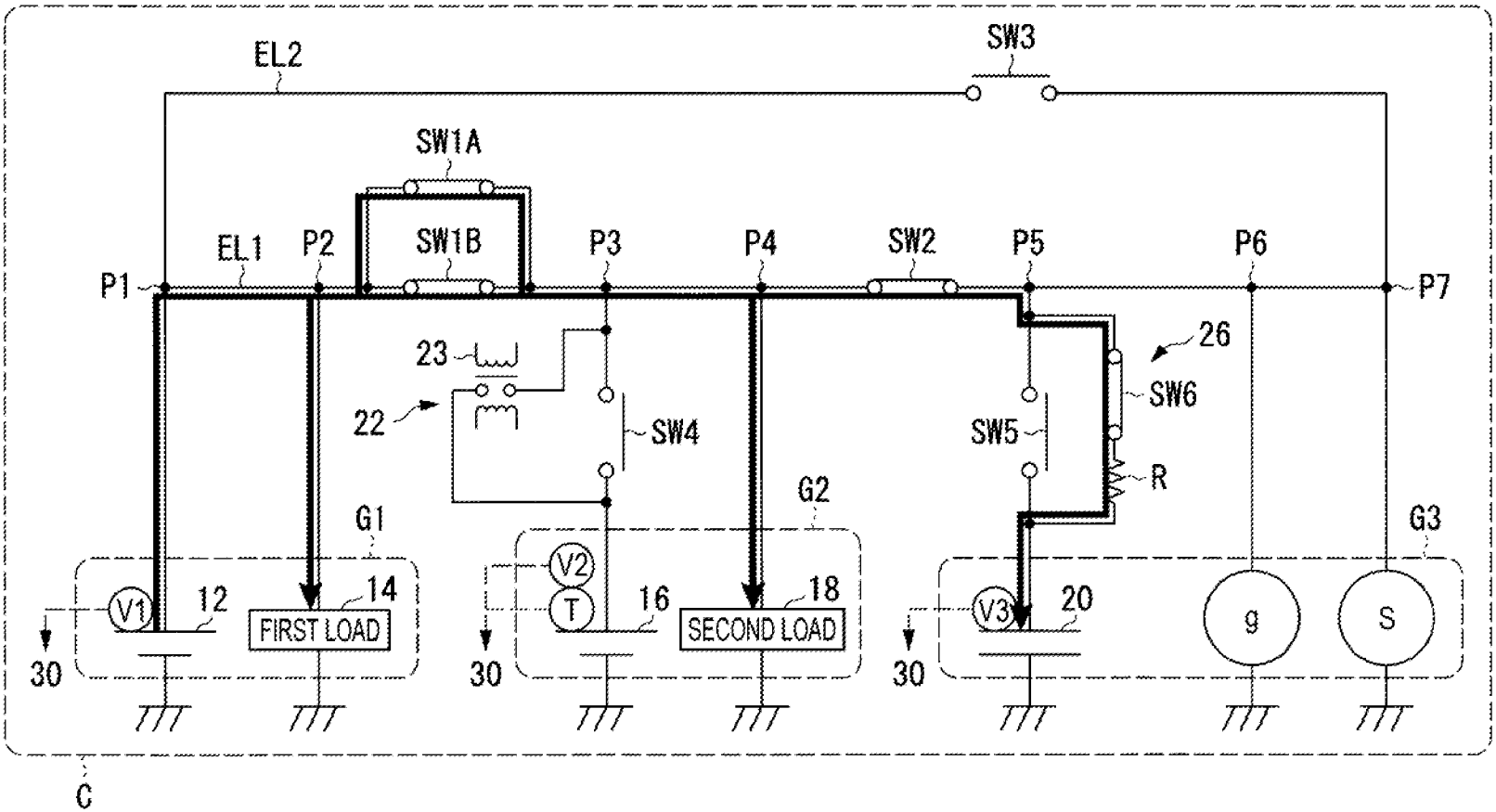
FIG. 6 is a diagram that illustrates a situation where the capacitor is charged.

FIG. 5 is a flowchart that illustrates the process from step S122, which is executed by turning on the ignition switch 40. The control unit 30 first determines whether or not the voltage of the capacitor 20 is a first voltage or higher (step S122). The control unit 30 determines whether or not the voltage of the capacitor 20 is 6 V or higher, for example. In a case where the voltage of the capacitor 20 is lower than the first voltage, the control unit 30 performs control to make the switch SW3, the switch SW4, and the switch SW5 the OFF state, performs control to make the switch SW1A, the switch SW1B, and the switch SW2 the ON state, performs control to make the switch SW6 the ON state, and thereby performs control to make the precharge circuit 26 the ON state (step S124). Accordingly, the capacitor 20 is charged by the current discharged from the first battery 12. FIG. 6 is a diagram that illustrates a situation where the capacitor 20 is charged. In this case, the control unit 30 may perform control to make the switch SW3 and the switch SW5 the OFF state, perform control to make the switch SW1A, the switch SW1B, the switch SW2, and the switch SW4 the ON state, perform control to make the switch SW6 the ON state, and thereby perform control to make the precharge circuit 26 the ON state.

Figure 7:
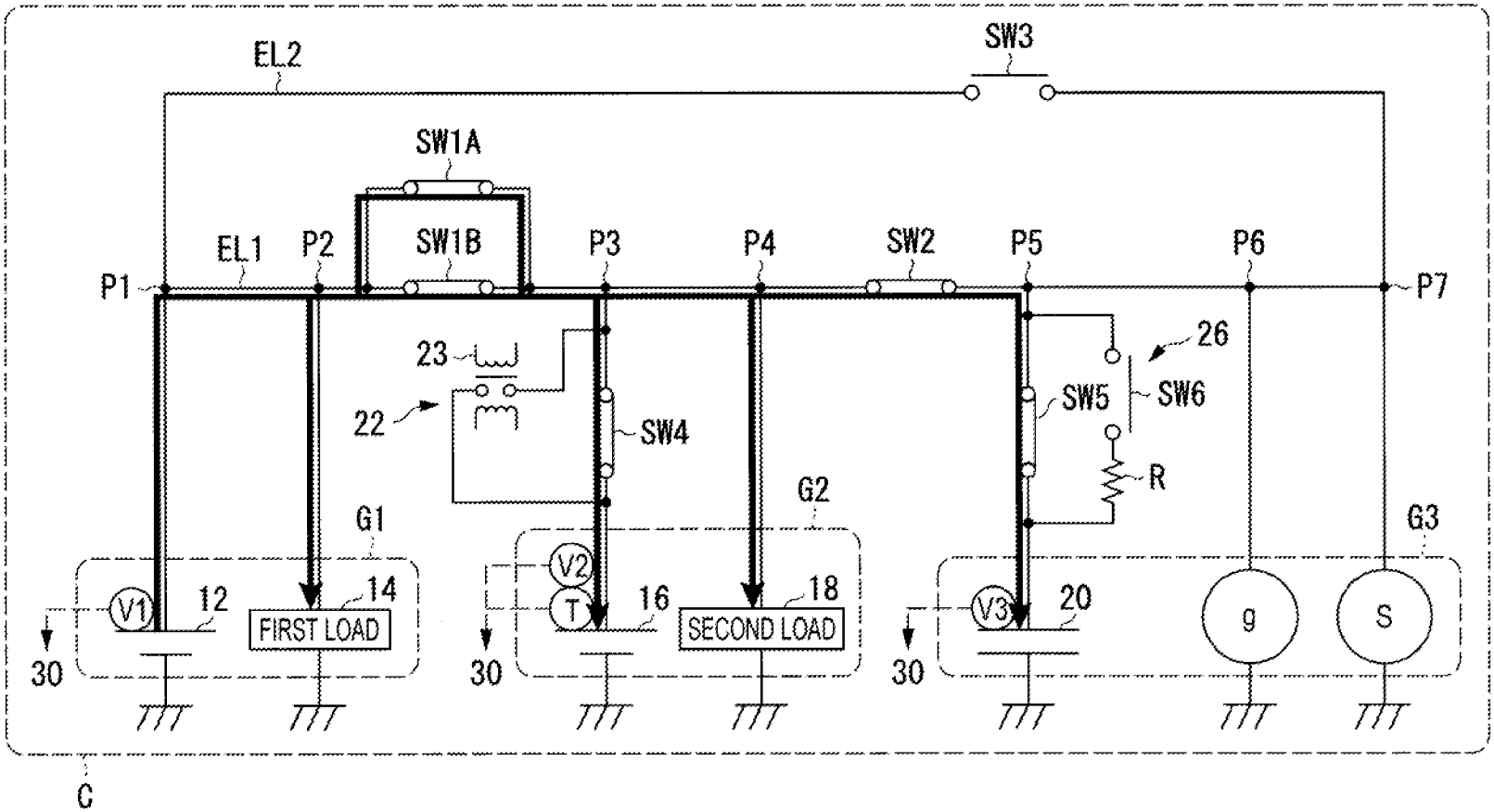
FIG. 7 is a diagram that illustrates a situation where conduction is established between the first battery and a second battery.

Next, in a case where the voltage of the capacitor 20 reaches a set voltage, the control unit 30 performs control to make the switch SW3 and the switch SW6 the OFF state and performs control to make the switch SW1A, the switch SW1B, the switch SW2, the switch SW4, and the switch SW5 the ON state (step S126). Accordingly, conduction is established between the first battery 12 and the second battery 16. FIG. 7 is a diagram that illustrates a situation where the conduction is established between the first battery 12 and the second battery 16. The control unit 30 establishes the conduction between the first battery 12 and the second battery 16, makes the switch SW6 the OFF state, and thereby performs system permission. The control unit 30 permits the starting device S to start because the first battery 12, the second battery 16, and the capacitor 20 have no abnormality, for example. Here, the control unit 30 makes the first battery 12 and the second battery 16 a conducting state and may thereby reduce a load to the first battery 12 and extend the life of the first battery 12.

In a case where the capacity of the second battery 16 decreases after the conduction is established between the first battery 12 and the second battery 16, the control unit 30 makes the switch SW4 the OFF state and may thereby extend the life of the second battery 16. Further, the control unit 30 makes the switch SW5 the OFF state after making the switch SW4 the OFF state. The control unit 30 breaks conduction between the capacitor 20 and the first battery 12 and may thereby extend the life of the capacitor 20.

In a case where the voltage of the capacitor 20 is lower than the first voltage, the control unit 30 performs control to make the switch SW1A, the switch SW1B, and the switch SW2 the OFF state, performs control to make the switch SW3 the ON state, performs control to make the switch SW4 and the switch SW6 the ON state, and thereby makes the precharge circuit 26 the ON state (step S128). Accordingly, the capacitor 20 is charged by the current discharged from the first battery 12.

The control unit 30 next determines whether or not the first voltage or higher is reached within a prescribed time (step S130). In a case where the control unit 30 determines that the first voltage or higher is not reached within the prescribed time, the control unit 30 performs control to make the switch SW1A to the switch SW2 and the switch SW4 to the switch SW6 the OFF state, performs control to make the switch SW3 the ON state, starts the starting device S (step S132), and moves the process to step S136 after the starting device S starts.

Figure 8:
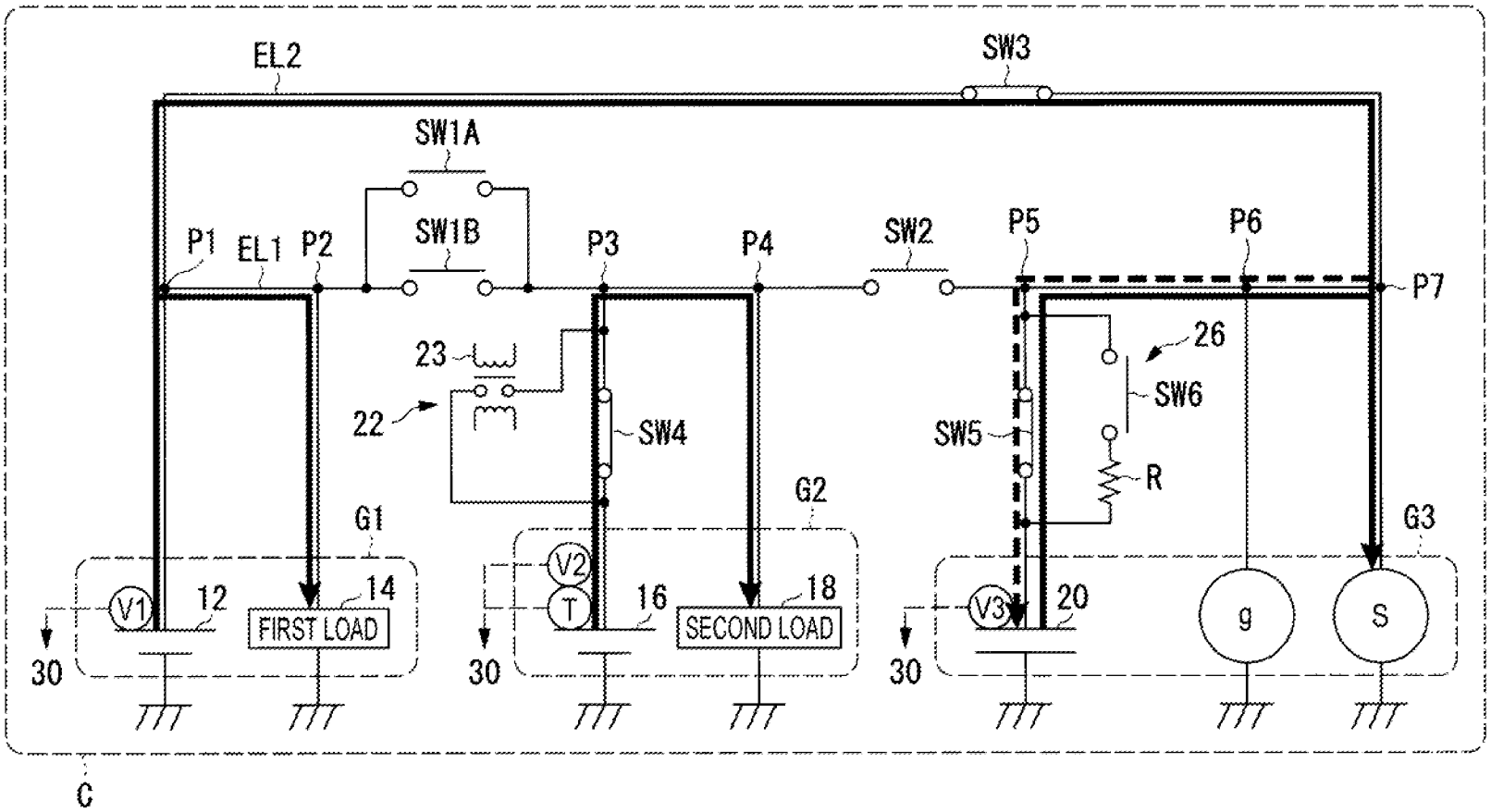
FIG. 8 is a diagram that illustrates a situation of a current flow in a case where a starting device is started.

In a case where the control unit 30 determines that the first voltage or higher is reached within the prescribed time, the control unit 30 performs control to make the switch SW1A, the switch SW1B, the switch SW2 and the switch SW6 the OFF state, performs control to make the switch SW3 to the switch SW5 the ON state, and thereby starts the starting device S (step S134). This process is a process that is executed in a case where the starter relay 44 is turned on, for example. FIG. 8 is a diagram that illustrates a situation of a current flow in a case where the starting device S is started. The control unit 30 performs control to make the switch SW1A and the switch SW1B the OFF state, for example, and thereby breaks conduction between the first load 14 and the second load 18. Accordingly, even in a case where the current of the first battery 12 is supplied to the starting device S, a voltage drop of the second load 18 may be reduced. Thus, influences on the ECU that controls steering and the ECU that controls an electronic brake may be reduced. Further, the control unit 30 performs control to make the switch SW2 the OFF state, for example, thereby breaks conduction between the second battery 16 and the capacitor 20, makes the switch SW3 the ON state, and may thereby supply a sufficient current for starting the starting device S to the starting device S. In a case where the charge on the capacitor 20 is not sufficient, control to make the switch SW3 the ON state is performed, and the current flows from the first battery 12 to the capacitor 20. The starting device S starts after the capacitor 20 is charged (or while the capacitor 20 is being charged).

Next, after the starting device S starts, the control unit 30 performs control to make the switch SW3 the OFF state (step S136). Here, the process of the flowchart finishes.

(Modification Example of Process of Turning Starter Relay 44 on)

Figure 9:
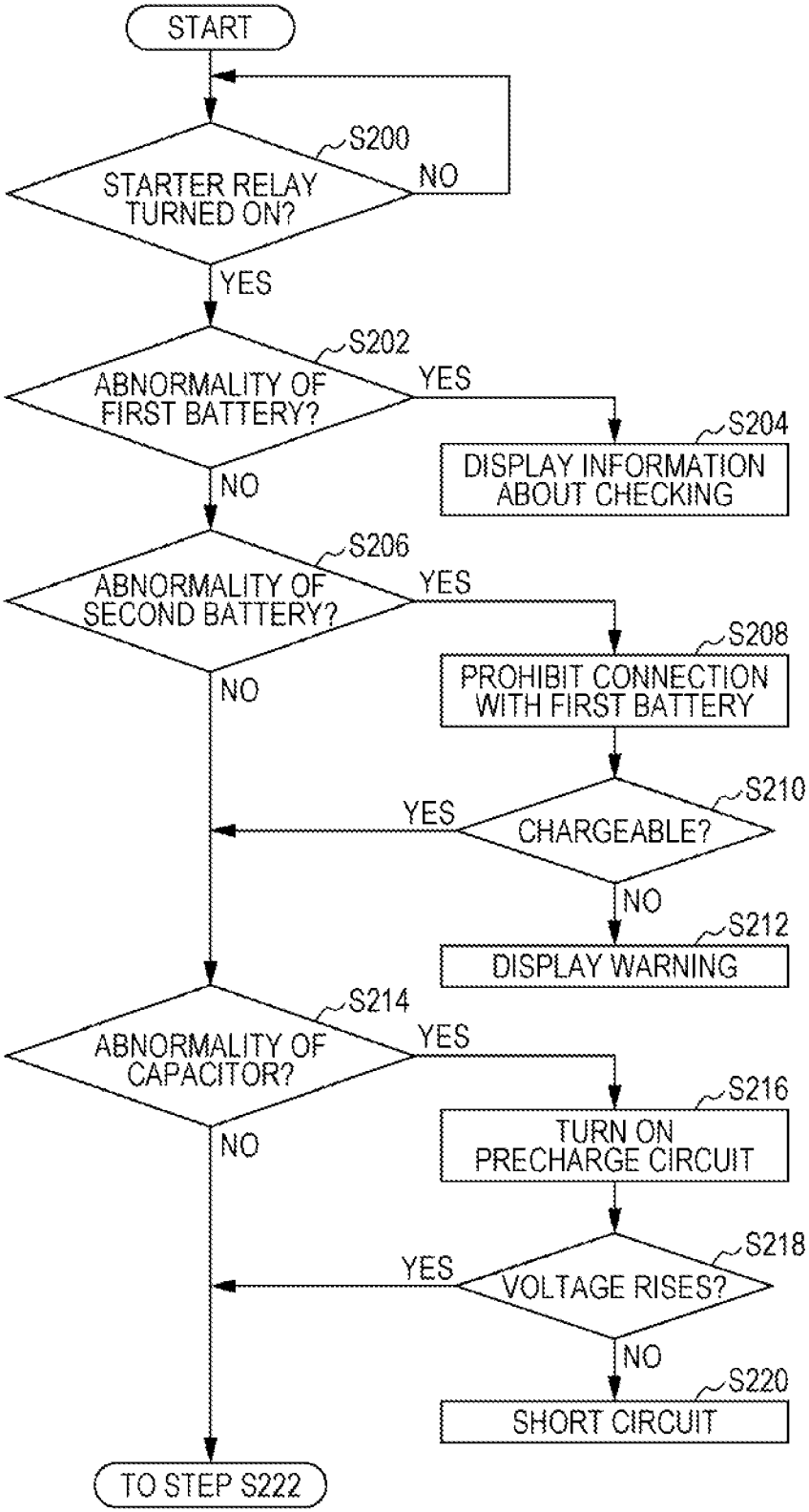
FIG. 9 is a flowchart that illustrates a flow of a process executed by turning on a starter relay.

FIG. 9 is a flowchart that illustrates a flow of a process executed by turning on the starter relay 44. This process is a process in a case where the transition is made from the ON state (initial state) of the ignition switch 40 to the ON state of the starter relay 44, for example. In a case where the ignition switch 40 is made the ON state, the electrical load that is necessary for starting the engine E is thereby started, and the starter relay 44 is made the ON state from this state (the ON state of the ignition switch 40), the FI-ECU 42 executes control to start the engine E.

The control unit 30 first waits until the starter relay 44 is made the ON state (step S200). In a case where the starter relay 44 is made the ON state, the control unit 30 determines whether or not the first battery 12 has abnormality (step S202). In a case where the control unit 30 determines that the first battery 12 has abnormality in step S202, the control unit 30 causes the display unit 50 to display information that indicates that checking the first battery 12 is advisable (step S204).

In a case where the control unit 30 determines that the first battery 12 has no abnormality, the control unit 30 determines whether or not the second battery 16 has abnormality (step S206). In a case where the control unit 30 determines that the second battery 16 has no abnormality, the control unit 30 moves the process to step S214. In a case where the control unit 30 determines that the second battery 16 has abnormality, the control unit 30 prohibits the connection between the first battery 12 and the second battery 16 (step S208), for example, and determines whether or not the second battery 16 is chargeable (step S210).

In a case where the control unit 30 determines that the second battery 16 is chargeable, the control unit 30 moves the process to step S214. In a case where the control unit 30 determines that the second battery 16 is not chargeable, the control unit 30 causes the display unit 50 to display warning information that indicates that the second battery 16 has abnormality (step S212).

The control unit 30 determines whether or not the capacitor 20 has abnormality (step S214). In a case where the control unit 30 determines that the capacitor 20 has abnormality, the control unit 30 performs control to make the switch SW1A, the switch SW1B, the switch SW2, and the switch SW5 the OFF state, performs control to make the switch SW3, the switch SW4, and the switch SW6 the ON state, and thereby makes the precharge circuit 26 the ON state (step S216; see step S116). Accordingly, the capacitor 20 is charged.

The control unit 30 next determines whether or not the voltage of the capacitor 20 rises (step S218). In a case where the control unit 30 determines that the voltage of the capacitor 20 does not rise, the control unit 30 determines that the capacitor 20 has abnormality (for example, short circuit has occurred) (step S220). In this case, the control unit 30 causes the display unit 50 to display information that indicates that the capacitor 20 has abnormality, for example. In a case where the control unit 30 determines that the voltage of the capacitor 20 rises, the control unit 30 determines that the capacitor 20 has no abnormality (for example, no short circuit has occurred) and moves the process to step S222.

Figure 10:
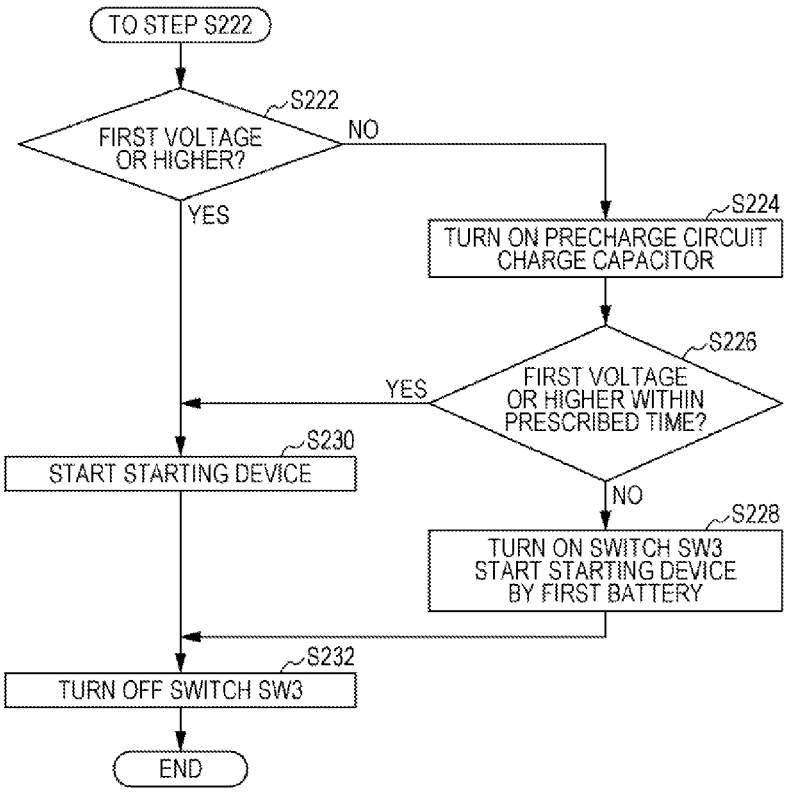
FIG. 10 is a flowchart that illustrates a process from step S222, which is executed by turning on the starter relay.

FIG. 10 is a flowchart that illustrates the process from step S222, which is executed by turning on the starter relay 44. The control unit 30 first determines whether or not the voltage of the capacitor 20 is the first voltage or higher (step S222). In a case where the voltage of the capacitor 20 is lower than the first voltage, the control unit 30 performs control to make the switch SW1A, the switch SW1B, the switch SW2, and the switch SW5 the OFF state, performs control to make the switch SW3 and the switch SW4 the ON state, performs control to make the switch SW6 the ON state, and thereby makes the precharge circuit 26 the ON state (step S224). Accordingly, the capacitor 20 is charged by the current discharged from the first battery 12.

The control unit 30 next determines whether or not the first voltage or higher is reached within a prescribed time (step S226). In a case where the control unit 30 determines that the first voltage or higher is not reached within the prescribed time, the control unit 30 performs control to make the switch SW1A to the switch SW2 and the switch SW4 to the switch SW6 the OFF state, performs control to make the switch SW3 the ON state, starts the starting device S (step S228), and moves the process to step S232 after the starting device S starts.

In a case where the control unit 30 determines that the voltage is the first voltage or higher in step S222 or the first voltage or higher is reached within the prescribed time, the control unit 30 starts the starting device S (step S230). The control unit 30 performs control to make the switch SW1A, the switch SW1B, the switch SW2 and the switch SW6 the OFF state, performs control to make the switch SW3, the switch SW4, and the switch SW5 the ON state, for example, and thereby starts the starting device S.

After the starting device S starts, the control unit 30 makes the switch SW3 the OFF state (step S232). Here, the process of the flowchart finishes. The control unit 30 may omit steps S200 to S220 and execute the process of steps S222 to S232.

(Process in Case of Abnormality of Capacitor 20)

Figure 11:
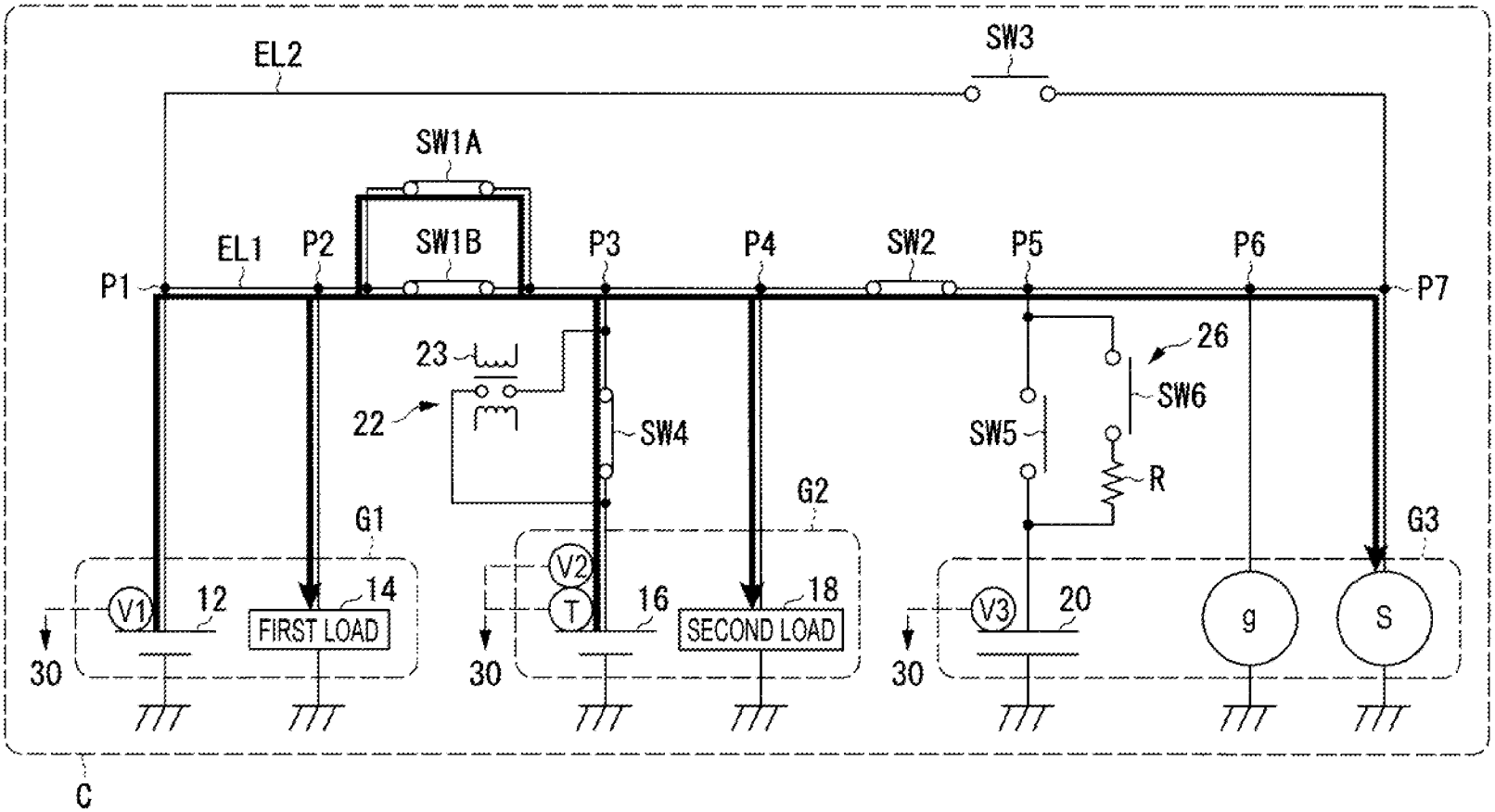
FIG. 11 is a diagram that illustrates a situation where the current is supplied from the first battery to the starting device.

In a case where the control unit 30 determines that the capacitor 20 has abnormality, the control unit 30 performs control to make the switch SW1A, the switch SW1B, the switch SW2, and the switch SW4 the ON state, performs control to make the switch SW3, the switch SW5, and the switch SW6 the OFF state, supplies the current from the first battery 12 to the starting device S, and may thereby starts the starting device S. FIG. 11 is a diagram that illustrates a situation where the current is supplied from the first battery 12 to the starting device S. A case of abnormality of the capacitor 20 is a case where the capacitor 20 has a prescribed temperature or higher or a lower temperature than a prescribed temperature, a case where the voltage does not rise to a prescribed value or higher within a prescribed time, or the like.

(Process in Case of Abnormality of Second Battery 16)

Figure 12:
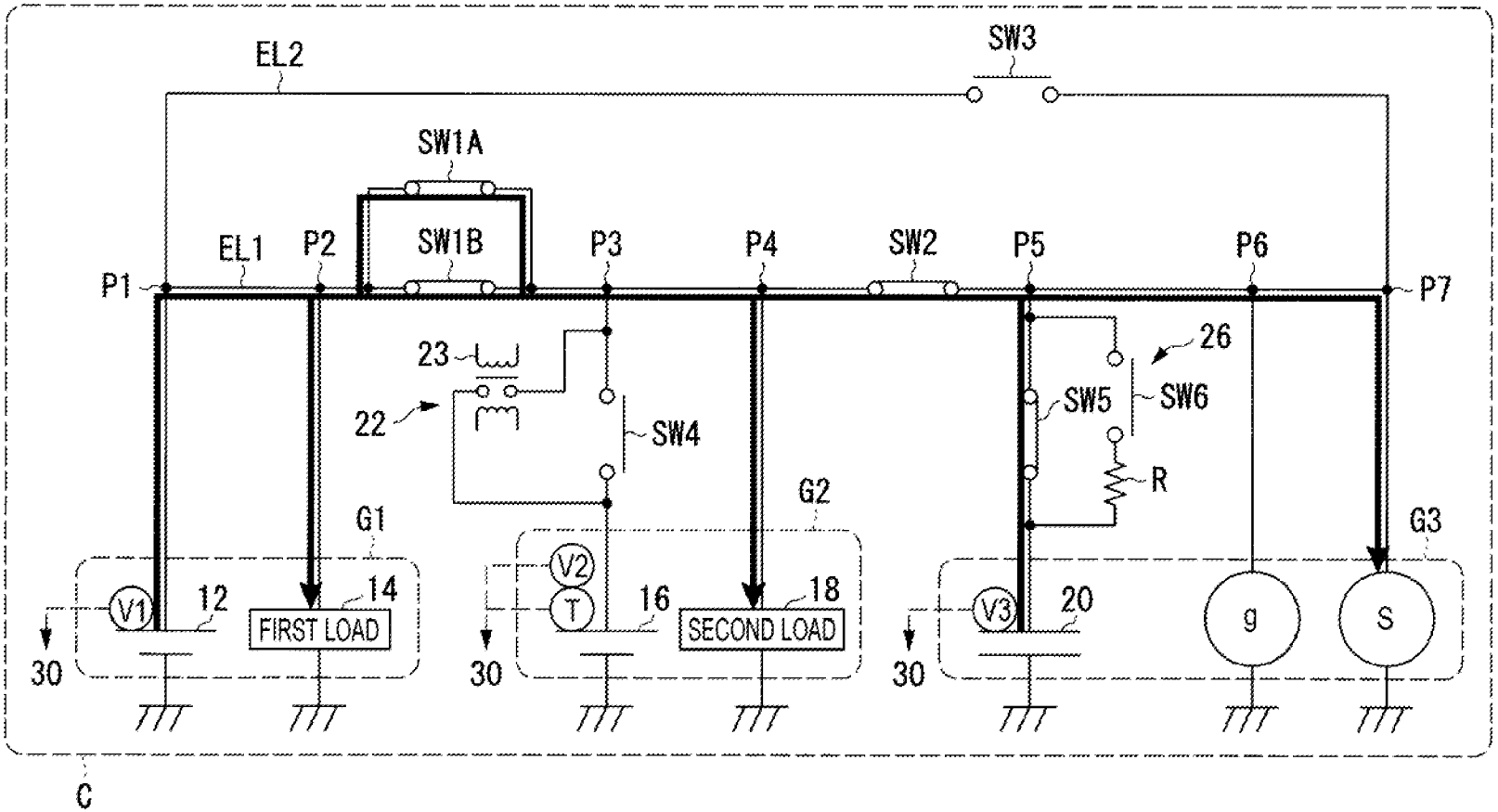
FIG. 12 is a diagram that illustrates a situation where the current is supplied from the first battery and the capacitor to the starting device in a case of abnormality of the second battery.

In a case where the control unit 30 determines that the second battery 16 has abnormality, the control unit 30 performs control to make the switch SW1A, the switch SW1B, the switch SW2, and the switch SW5 the ON state, performs control to make the switch SW3, the switch SW4, and the switch SW6 the OFF state, supplies the current from the first battery 12 or the capacitor 20 to the starting device S, and may thereby starts the starting device S. FIG. 12 is a diagram that illustrates a situation where the current is supplied from the first battery 12 and the capacitor 20 to the starting device S in a case of abnormality of the second battery 16. A case of abnormality of the second battery 16 is a case where the second battery 16 has a prescribed temperature or higher or a lower temperature than a prescribed temperature, a case where the voltage does not rise to a prescribed value or higher within a prescribed time, or the like.

(Process in Regeneration)

Figure 13:
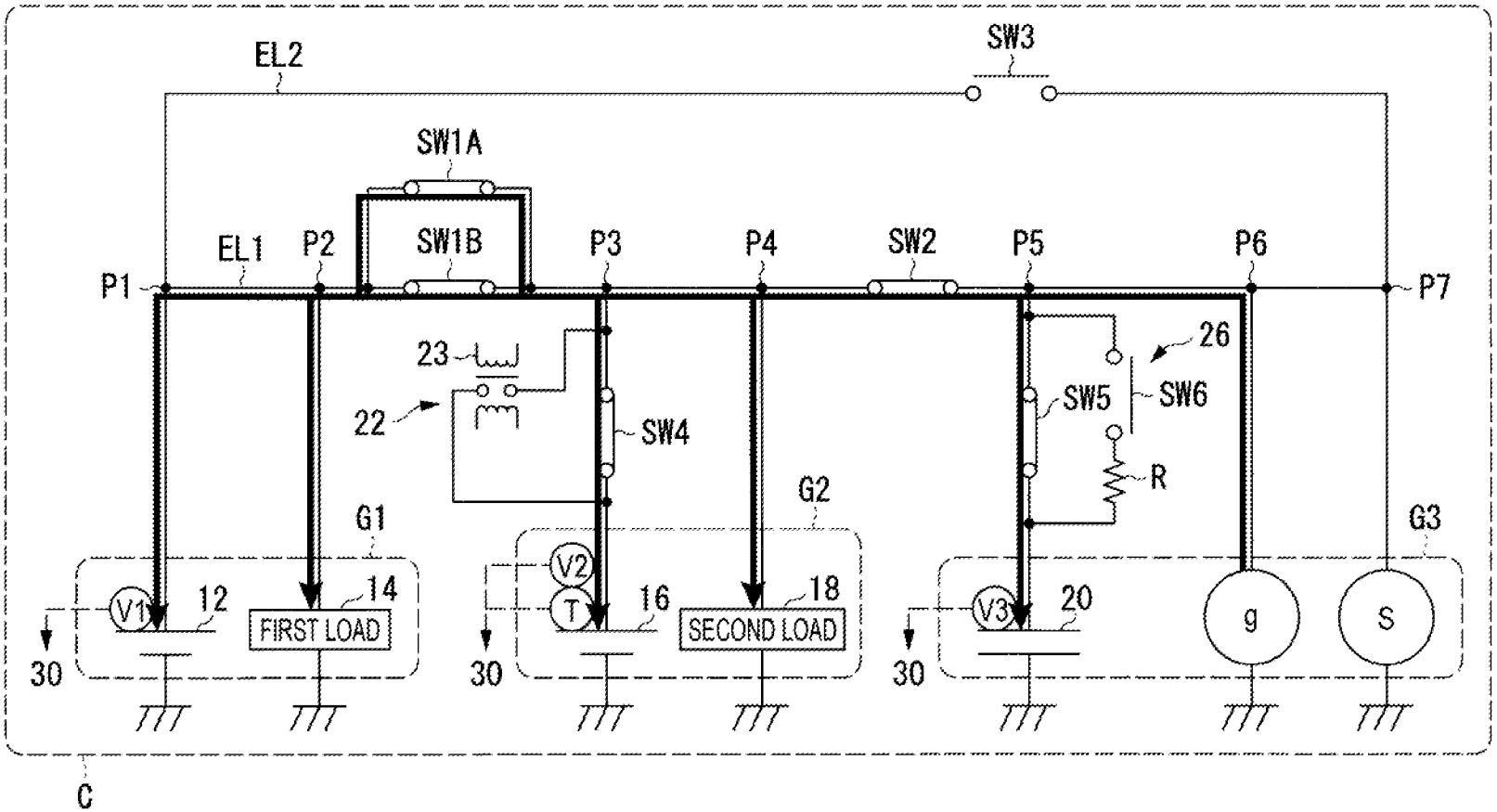
FIG. 13 is a diagram that illustrates a situation where regenerative power is supplied from a generator to components.

In a case where the generator g outputs regenerative power, the control unit 30 makes the switch SW3 and the switch SW6 the OFF state, performs control to make the switch SW1A, the switch SW1B, the switch SW2, the switch SW4, and the switch SW5 the ON state, and supplies the regenerative power to the first battery 12, the first load 14, the second battery 16, the second load 18, and the capacitor 20. FIG. 13 is a diagram that illustrates a situation where the regenerative power is supplied from the generator g to the components. The control unit 30 determines whether or not the charge state of the second battery 16 is a threshold value or more. In a case where the control unit 30 determines that the charge state of the second battery 16 is the threshold value or more, the control unit 30 performs system permission. The control unit 30 confirms initial states of the first load 14 and the second load 18, for example. In a case where the initial state is not normal, the control unit 30 restricts the start of the load that is not normal.

(Process in Regeneration Stopping State and Idle Reduction State)

Figure 14:
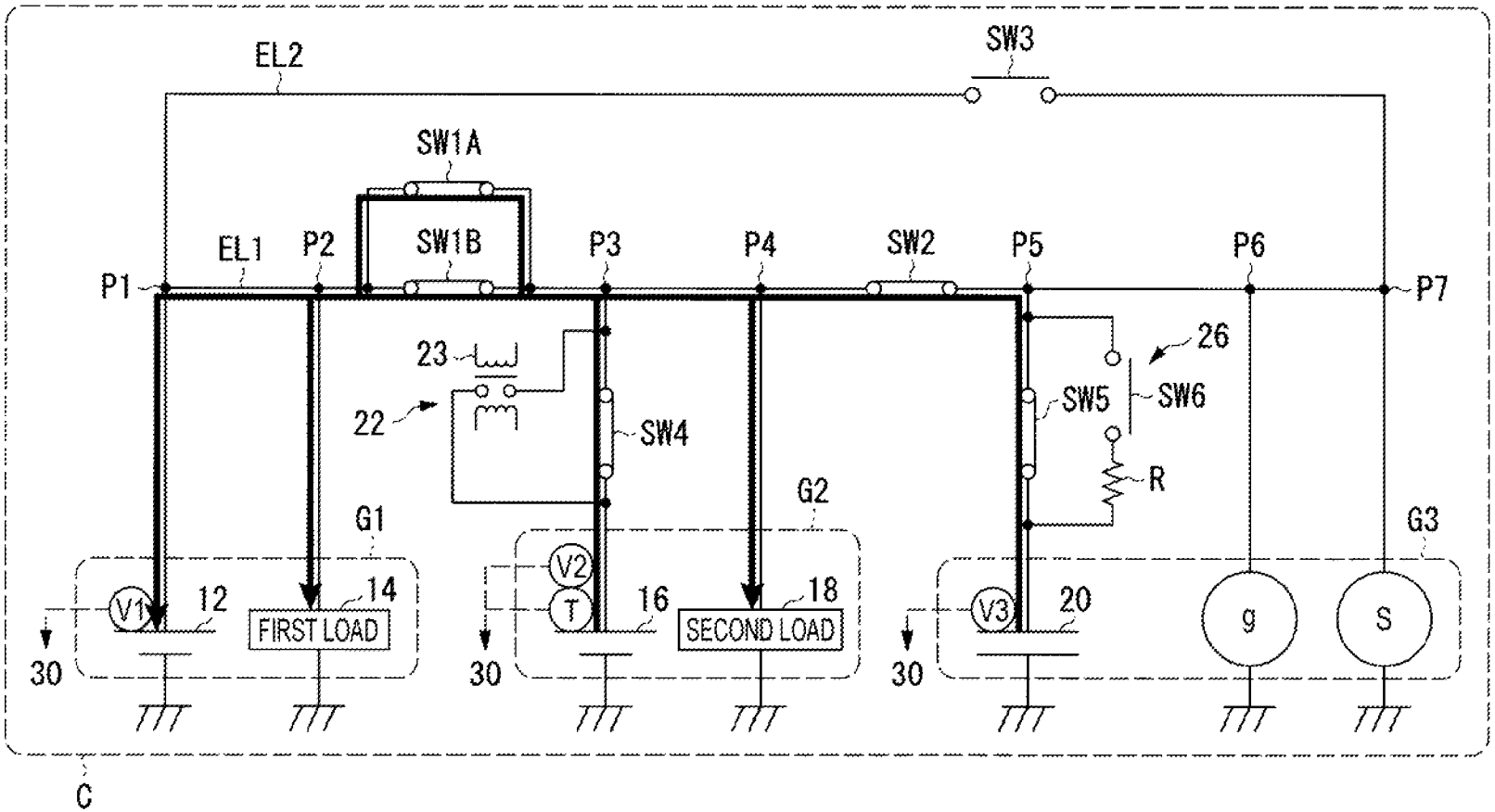
FIG. 14 is a diagram that illustrates a situation where the current is discharged in a regeneration stopping state and an idle reduction state.

In a case where regeneration is stopped and where idling is stopped, the control unit 30 performs control to make the switch SW3 and the switch SW6 the OFF state, performs control to make the switch SW1A, the switch SW1B, the switch SW2, the switch SW4, and the switch SW5 the ON state, and causes the second battery 16 to actively discharge. FIG. 14 is a diagram that illustrates a situation where the current is discharged in the regeneration stopping state and the idle reduction state. Because the electric potential of the second battery 16 is higher than the electric potential of the first battery 12, discharge is performed from the second battery 16, and discharge from the first battery 12 may thereby be reduced.

(Process of Restarting after Idling is Stopped)

Figure 15:
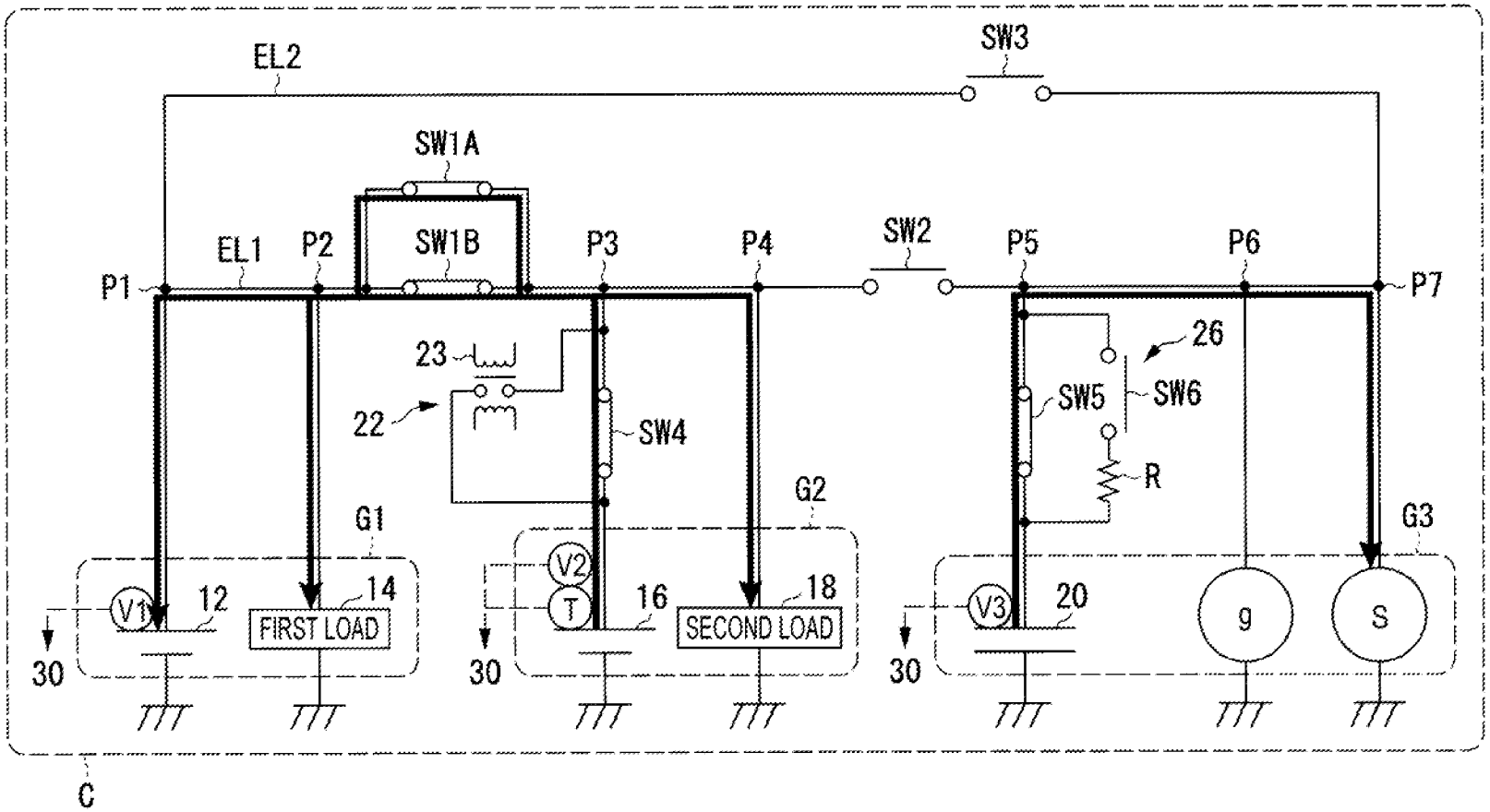
FIG. 15 is a diagram that illustrates a situation where the current is discharged from the capacitor in a case where an engine is restarted after idling is stopped.

In a case where a return request for restarting the engine E is made after idling is stopped, the control unit 30 performs control to make the switch SW2, the switch SW3, and the switch SW6 the OFF state, and performs control to make the switch SW1A, the switch SW1B, the switch SW4, and the switch SW5 the ON state, supplies the current from the capacitor 20 to the starting device S, and thereby starts the starting device S. FIG. 15 is a diagram that illustrates a situation where the current is discharged from the capacitor 20 in a case where the engine E is restarted after idling is stopped. The control unit 30 starts the starting device S by using only the capacitor 20 and supplies the current from the first battery 12 and the second battery 16 to the first load 14 and the second load 18. Accordingly, the control unit 30 may reduce the voltage fluctuation that occurs to the first load 14 or the second load 18 when the starting device S starts. Further, even in a case where a defect occurs to the first battery 12 or the second battery 16, the current may be supplied from the first battery 12 or the second battery 16, to which no defect occurs, to the first load 14 or the second load 18.

(Process in Case where Ignition Switch 40 is Turned Off after Travel)

Figure 16:
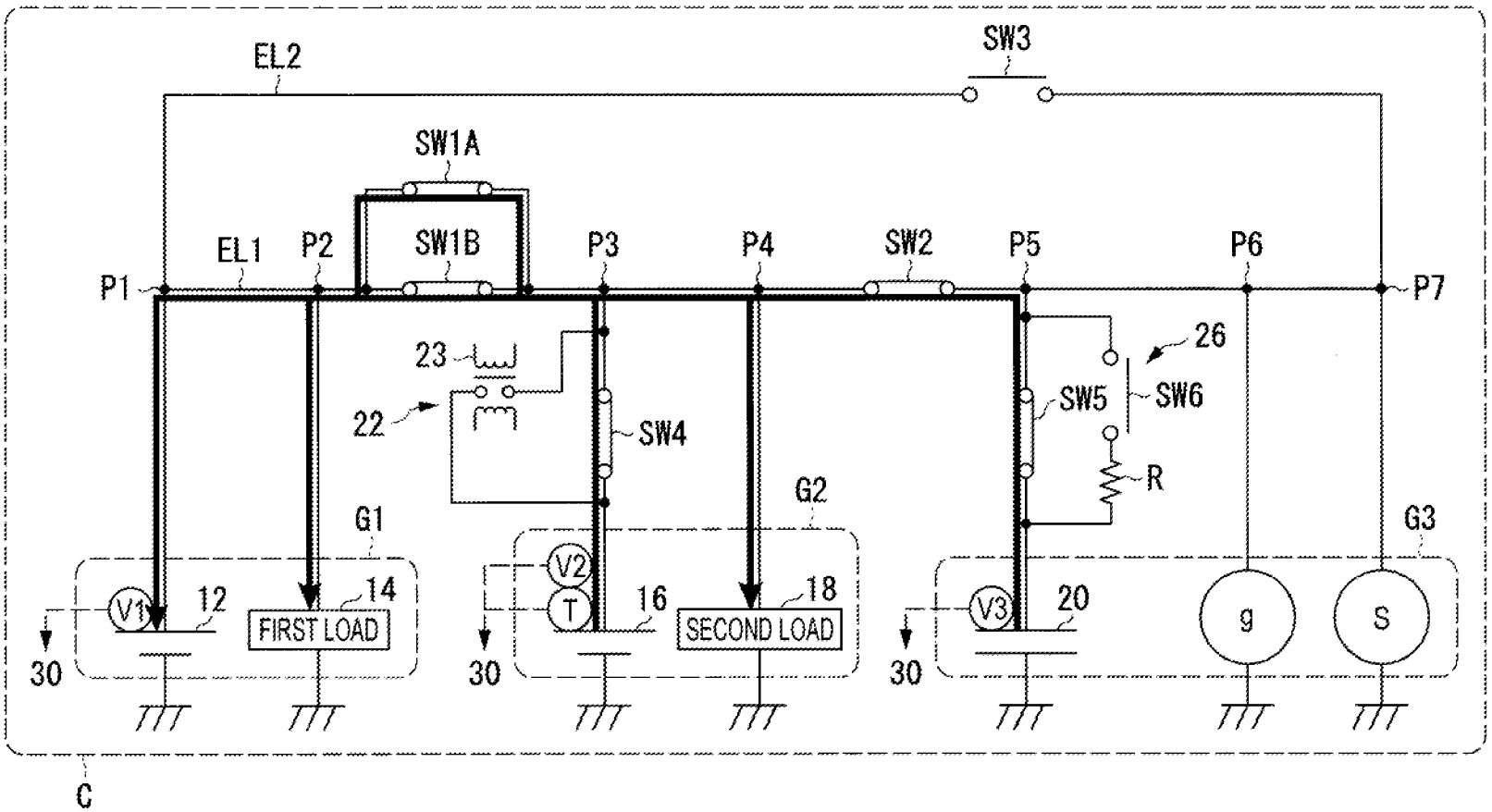
FIG. 16 is a diagram that illustrates a situation of a current flow in a case where the ignition switch is turned off after travel.

In a case where the ignition switch 40 is turned off after travel by using the output of the engine E, the control unit 30 performs control to make the switch SW3 and the switch SW6 the OFF state, performs control to make the switch SW1A, the switch SW1B, the switch SW2, the switch SW4, and the switch SW5 the ON state, and supplies the current from the second battery 16 to the first battery 12, the first load 14, and the second load 18. FIG. 16 is a diagram that illustrates a situation of a current flow in a case where the ignition switch 40 is turned off after travel. The illustrated example is based on an assumption that travel is performed in a state where self-discharge of the power accumulated in the first battery 12 occurs and the capacity decreases, and the ignition switch 40 is thereafter turned off in a state where the first battery 12 is not sufficiently charged. In this case, because the control unit 30 supplies the current from the second battery 16 to the first battery 12, discharge of the current from the first battery 12 or the capacitor 20 may be reduced. As a result, deterioration (sulfation) of the first battery 12, deterioration of the capacitor 20, and so forth may be reduced.

(Process in Case where Engine E Stops and First Battery 12 has Defect)

Figure 17:
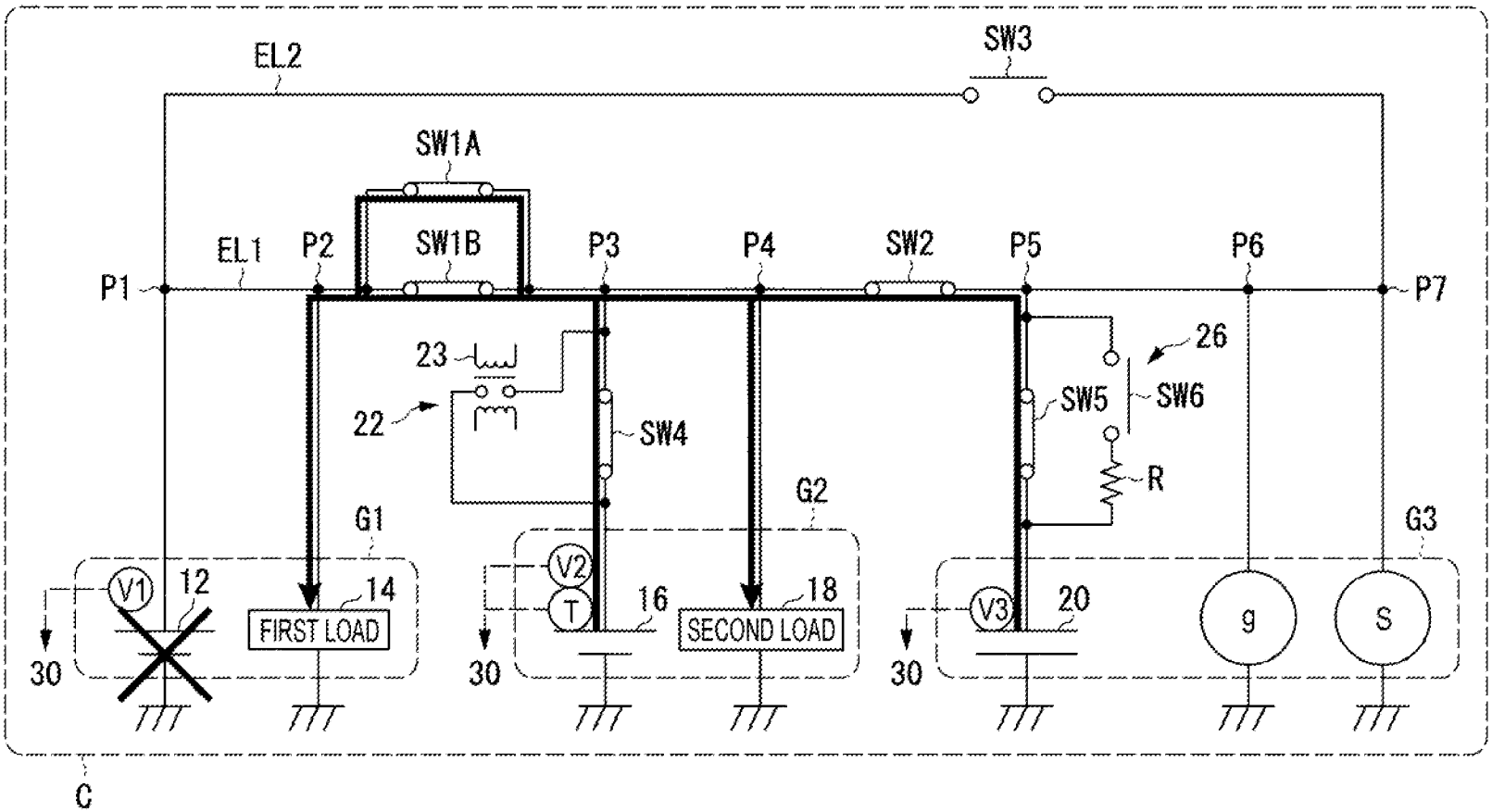
FIG. 17 is a diagram that illustrates a situation of a current flow in a case where an engine operation stops and the first battery has a defect.

In a case where the engine E stops and the first battery 12 has a defect, the control unit 30 performs control to make the switch SW3 and the switch SW6 the OFF state, performs control to make the switch SW1A, the switch SW1B, the switch SW2, the switch SW4, and the switch SW5 the ON state, and supplies the current from the second battery 16 to the first load 14 and the second load 18. FIG. 17 is a diagram that illustrates a situation of a current flow in a case where the operation of the engine E stops and the first battery 12 has a defect. Accordingly, even in a case where a defect occurs to the first battery 12, the control unit 30 may supply power from the second battery 16 to the first load 14 or the second load 18. The control unit 30 performs control to make the switch SW1A and the switch SW1B the OFF state, thereby breaks conduction between the first load 14 and the second battery 16, and may supply power from the second battery 16 to the second load 18. In this case, the control unit 30 may reduce the power capacity of the second battery 16.

(Process of Turning Latching Relay 23 on)

Figure 18:
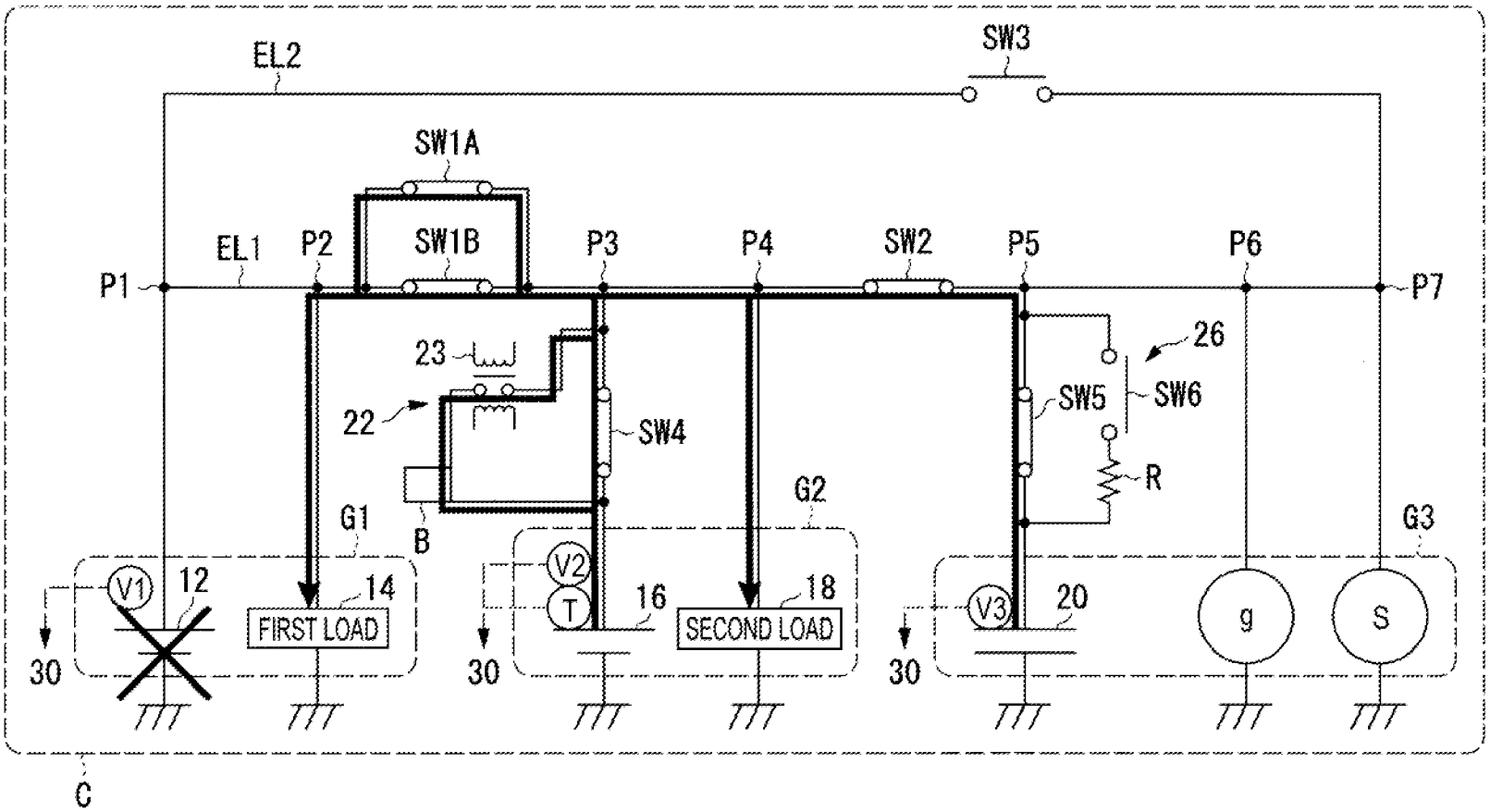
FIG. 18 is a diagram that illustrates a situation of a current flow in a case where control to make a latching relay an ON state is performed.

In a case where a defect occurs to the first battery 12, the control unit 30 detects the state of the second battery 16. In a case where the control unit 30 determines that the electric storage capacity of the second battery 16 is a reference value or more, for example, the control unit 30 performs control to make the latching relay 23 the ON state. The latching relay 23 is a circuit that maintains immediately prior operation or return state even if energization is not performed after operation (setting) or return (resetting) is performed by energization. FIG. 18 is a diagram that illustrates a situation of a current flow in a case where control to make the latching relay 23 the ON state is performed. Accordingly, even in a case where a defect occurs to the first battery 12, the control unit 30 may supply power to the first load 14 or the second load 18. The control unit 30 performs control to make the switch SW1A and the switch SW1B the OFF state, thereby breaks the conduction between the first load 14 and the second battery 16, and may supply power from the second battery 16 to the second load 18. In this case, the control unit 30 may reduce the power capacity of the second battery 16. Further, as illustrated in FIG. 18, the vehicle power source device 10 may include a button B for performing control to turn on the latching relay 23. For example, in a case where the button B is operated by the driver or the like, the control unit 30 acquires, from the button B, a signal that indicates the button B is operated and then causes the latching relay 23 to operate.

As described above, the control unit 30 controls the switch SW1A to the switch SW6 in accordance with the operation state of the vehicle and thereby controls charge and discharge of the first battery 12, the second battery 16, and the capacitor 20. FIG. 19 illustrates one example of the relationship between vehicle states and control of the switches SW. In a case where the first battery 12 is deteriorated or where the capacity of the first battery 12 decreases and charge is necessary (in a case of a jump start), control to make the switch SW1A the ON state and control to make the switch SW1B to the switch SW6 the OFF state are performed. For example, in this state, an external power source is electrically connected with the first battery 12, and power may thereby be supplied from the external power source to the first battery 12.

In the vehicle power source device 10 of the above-described first embodiment, when the engine E is started, the control unit 30 performs control to turn off the first switches SW1A and SW1B that are provided between the first group G1, which includes the first battery 12 and the first load 14 connected with the first battery 12, and the second group G2, which includes the second battery 16 and the second load 18 connected with the second battery 16, performs control to turn off the second switch SW2 that is provided between the second group G2 and the third group G3, which includes the starting device S for starting the engine E and the capacitor 20, performs control to turn on the third switch SW3 that is provided between the first group G1 and the third group G3, and may thereby perform appropriate power control when the engine E is started.

Second Embodiment

A second embodiment will hereinafter be described. A vehicle power source device 100 in the second embodiment is different from the vehicle power source device 10 in the first embodiment in the arrangement of switches SW and so forth that are connected with the circuit. In the description made below, the same reference characters will be given to functions and configurations that are the same as the functions and configurations of the vehicle power source device 10 of the first embodiment, and descriptions thereof will not be made. The differences from the vehicle power source device 10 of the first embodiment will mainly be described.

Figure 20:
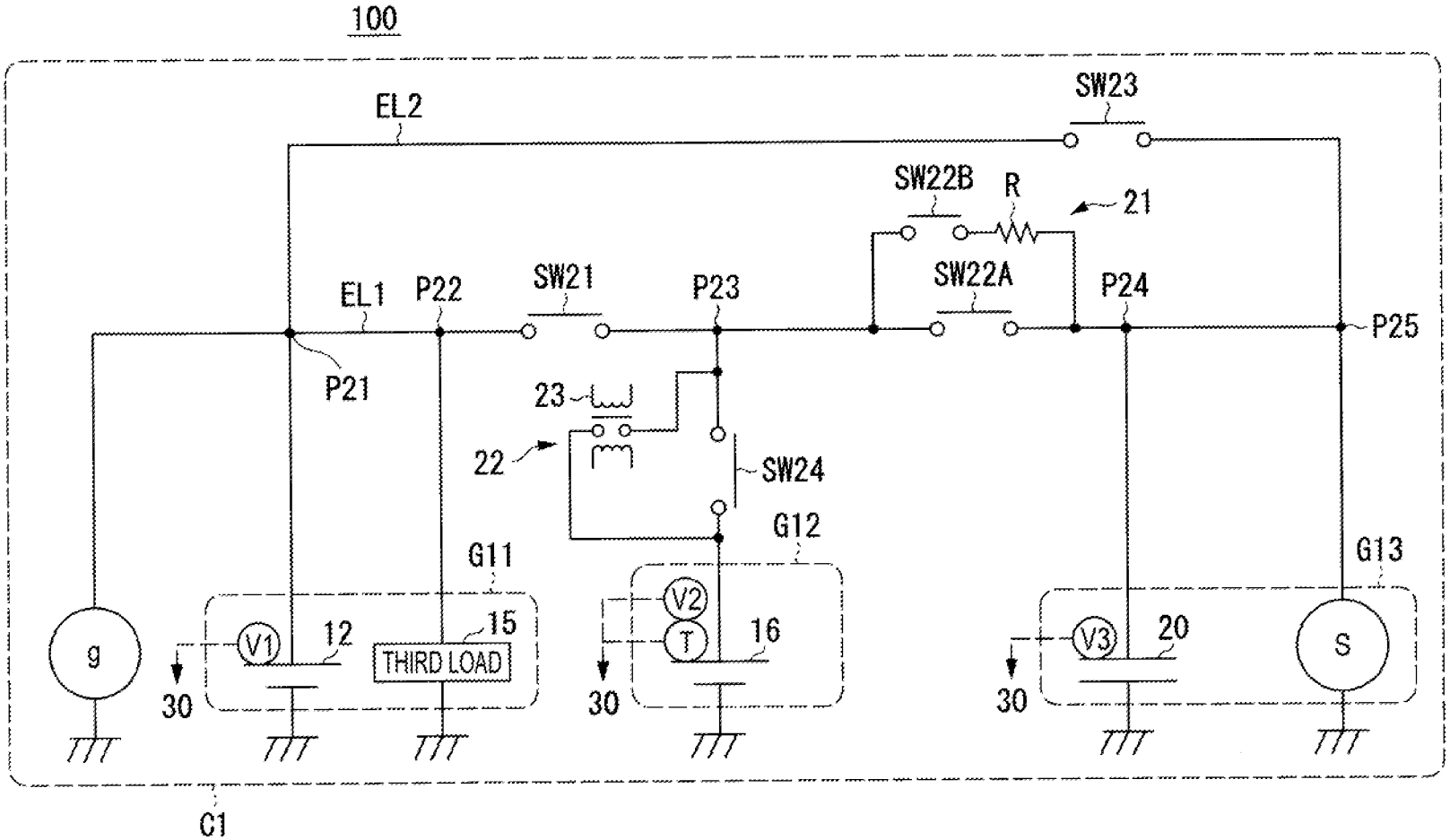
FIG. 20 is a diagram that illustrates a configuration of a circuit of a vehicle power source device of a second embodiment.

FIG. 20 is a diagram that illustrates a configuration of a circuit C1 of the vehicle power source device 100 of the second embodiment. The circuit C1 of the vehicle power source device 100 includes the first battery 12, a third load 15, the second battery 16, the starting device S, the capacitor 20, the latch circuit 22, the generator g, a switch SW21, a switch SW22A, a switch SW23, a switch SW24, a precharge circuit 21, the sensors V1 to V3, and the sensor T, for example.

The circuit C1 of the vehicle power source device 100 includes a loop electric line that is formed with the first electric line EL1 and the second electric line EL2. The first electric line EL1 is connected with the first battery 12, the third load 15, the second battery 16, the starting device S, the generator g, the latch circuit 22, the capacitor 20, the switch SW21, and the precharge circuit 21. The generator g is connected between the switch SW21 and the switch SW23, for example.

(First Group)

The first battery 12 is connected to a vicinity of a joining point P21 between the first electric line EL1 and the second electric line EL2, for example. The third load 15 is connected with a joining point P22 between the joining point P21 and the switch SW21, for example. The third load 15 is an in-vehicle apparatus such as an air conditioner, a rear window defogger, or a seat heater provided in the vehicle, which does not request relatively long time for start or return of a power source, and/or an in-vehicle apparatus such as a navigation device provided in the vehicle, which requests long time for start or return of the power source compared to the first load 14. Further, the third load 15 may be an in-vehicle apparatus such as a central processing unit (CPU) related to the vehicle operation, such as an ECU that controls an electric steering device or an ECU that controls an electric brake device, for example. The first battery 12 and the third load 15 are included in a first group G11.

(Second Group)

The second battery 16 is connected with a joining point P23 between the switch SW21 and the switch SW22A, for example. The second battery 16 is included in a second group G12.

(Third Group)

The starting device S is connected with a joining point P25 between the switch SW22A and the switch SW23, for example. The capacitor 20 is connected to a vicinity of a joining point P24 between the switch SW22A and the switch SW23, for example. The starting device S and the capacitor 20 are included in a third group G13.

(Switches SW and so Forth)

The switch SW21 is another example of the first switch. The switch SW21 is connected between the first group G11 and the second group G12 of the first electric line EL1, for example. The switch SW21 is a contact point such as an electromagnetic contactor, for example. A switch used for the switch SW21 is a normally open contact point.

The switch SW22A is another example of the second switch. The switch SW22A is connected between the second group G12 and the third group G13 of the first electric line EL1, for example. The switch SW22A is a contact point such as an electromagnetic contactor, for example, and is a normally open contact point.

The precharge circuit 21 is connected in parallel with the switch SW22A. The precharge circuit 21 is a circuit in which the switch SW22B and the resistor R are connected together in series. The switch SW22B is another example of the second switch. The switch SW22B is a contact point such as an electromagnetic contactor, for example, and is a normally open contact point. The resistor R has a higher resistance value than the resistance value of the capacitor 20. The ON state of the second switch means that either switch of the switch SW22A and the switch SW22B is in the ON (conducting) state.

The switch SW23 is another example of the third switch. The switch SW23 is connected between the first group G11 and the third group G13 of the second electric line EL2, for example. The switch SW23 is a contact point such as an electromagnetic contactor, for example, and is a normally open contact, point. Further, the switch SW23 is a contact point with a large capacity compared to the other switches SW21, the switch SW22A, the switch SW22B, and the switch SW24.

The switch SW24 is another example of the fourth switch. The switch SW24 is provided between the joining point P23 and the second battery 16. The switch SW24 is a contact point such as an electromagnetic contactor, for example, and is a normally open contact point. Further, the latch circuit 22 that includes the latching relay 23 is connected in parallel with the switch SW24.

(OFF State of Ignition Switch 40)

In the OFF state of the ignition switch 40, the control unit 30 performs control to make all the switches SW the OFF state. Because the vehicle power source device 100 of this embodiment has the switch SW24 in the open state, the discharge of the dark current from the second battery 16 may be blocked.

(Process of Turning Ignition Switch 40 on)

Figure 21:
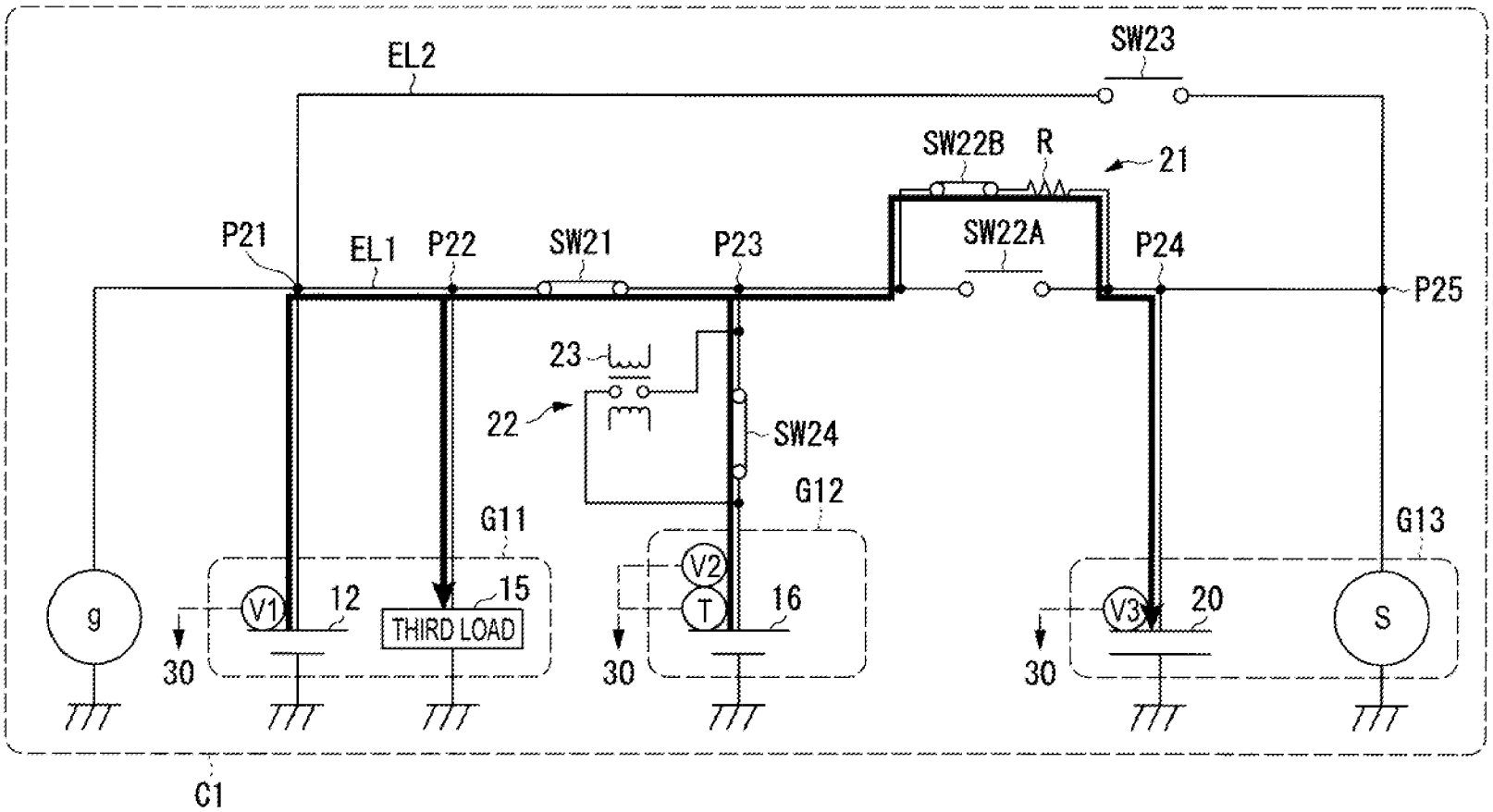
FIG. 21 is a diagram that illustrates a situation where the capacitor is charged.

In the ON state of the ignition switch 40, the control unit 30 performs control to make the switch SW21, the switch SW22B, and the switch SW24 the ON state, performs control to make the switch SW22A and the switch SW23 the OFF state, and thereby makes the precharge circuit 21 the ON state. The control unit 30 supplies the current from the first battery 12 and the second battery 16 to the third load 15 and also supplies the current to the capacitor 20. Accordingly, the capacitor 20 is charged by the discharge from the first battery 12 or the second battery 16. FIG. 21 is a diagram that illustrates a situation where the capacitor 20 is charged. Because the capacitor 20 has a low resistance, a large current flows into the capacitor 20 in a case where the electric potential difference between the capacitor 20 and the first battery 12 is large. The precharge circuit 21 is provided with the resistor R with a higher resistance than the capacitor 20 and may thus reduce a rapid voltage drop and deterioration of the first battery 12. Further, damage to the switches and so forth that are connected with the circuit C1 of the vehicle power source device 100 may be reduced.

(Starting Process of Starting Device S after Turning Ignition Switch 40 on (Initial Starting))

Figure 22:
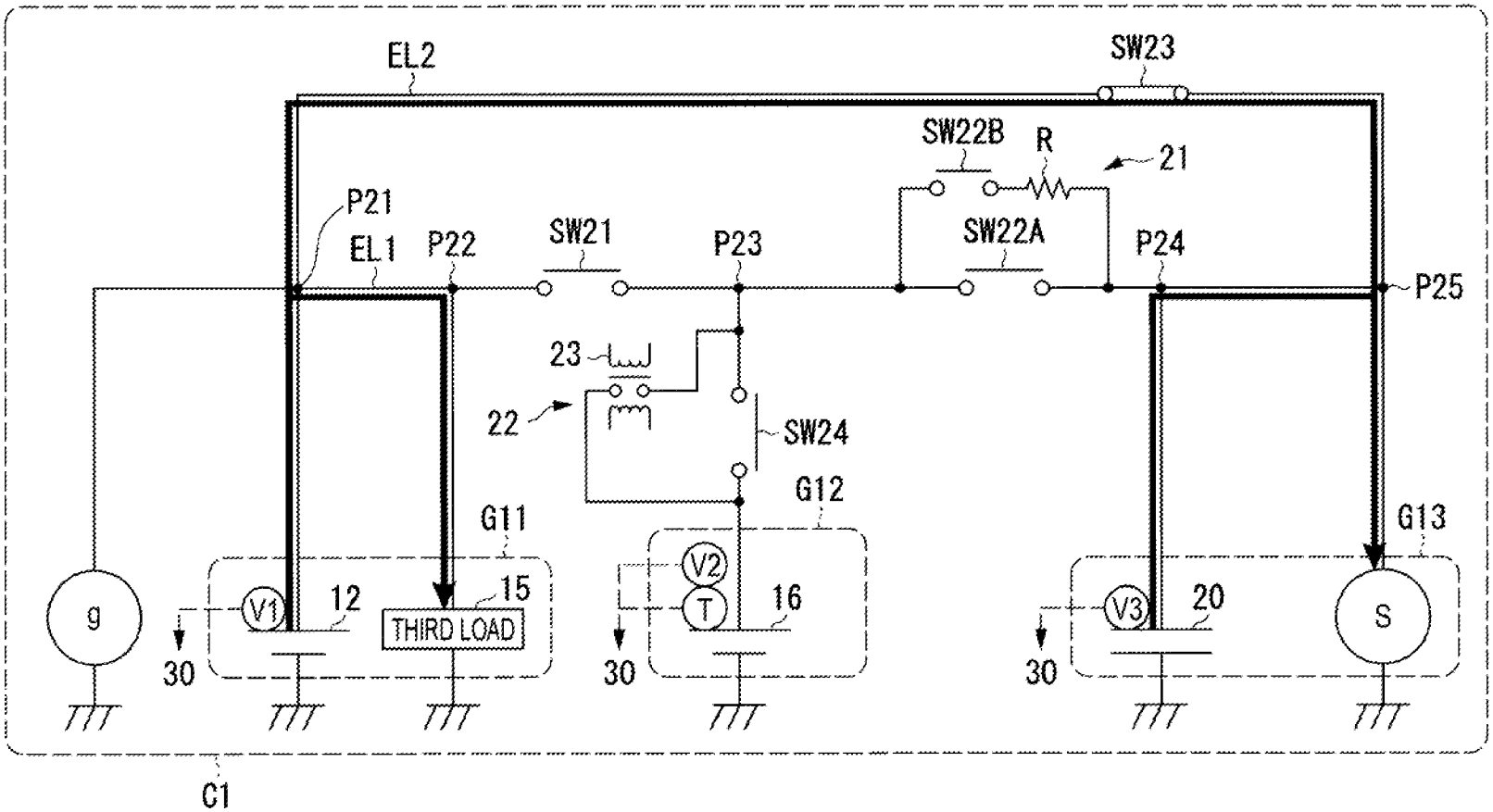

The control unit 30 performs control to make the switch SW21, the switch SW22A, the switch SW22B, and the switch SW24 the OFF state, performs control to make the switch SW23 the ON state, for example, supplies the current from the first battery 12 and the capacitor 20 to the starting device S, and thereby starts the starting device S. FIG. 22 is a diagram that illustrates a current flow in a case where the starting device S is started after the ignition switch 40 is turned on. The control unit 30 performs control to make the switch SW22A and the switch SW22B the OFF state, for example, thereby breaks the conduction between the second battery 16 and the capacitor 20, makes the switch SW23 the ON state, and thereby supplies a sufficient current for starting the starting device S to the starting device S. In a case where the charge on the capacitor 20 is not sufficient, control to make the switch SW23 the ON state is performed, and the current flows from the first battery 12 to the capacitor 20. The starting device S starts after the capacitor 20 is charged (or while the capacitor 20 is being charged).

(Process in Regeneration)

Figure 23:
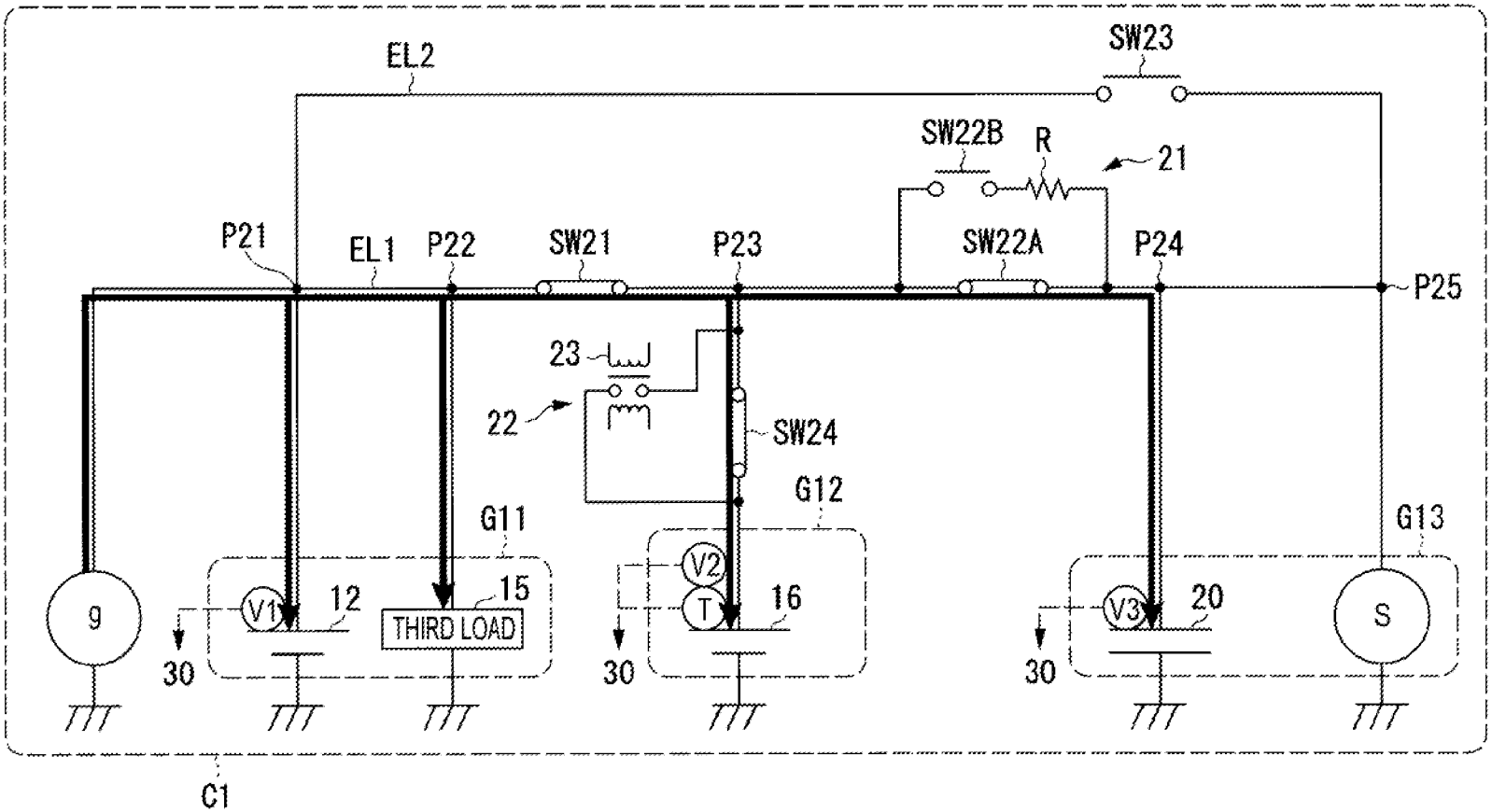
FIG. 23 is a diagram that illustrates a situation where regenerative power is supplied from the generator to components.

In a case where the generator g outputs regenerative power, the control unit 30 makes the switch SW22B and the switch SW23 the OFF state, performs control to make the switch SW21, the switch SW22A, and the switch SW24 the ON state, and supplies the regenerative power to the first battery 12, the third load 15, the second battery 16, and the capacitor 20. FIG. 23 is a diagram that illustrates a situation where the regenerative power is supplied from the generator g to the components. The control unit 30 determines whether or not the charge state of the second battery 16 is a threshold value or more. In a case where the control unit 30 determines that the charge state of the second battery 16 is the threshold value or more, the control unit 30 performs system permission. The control unit 30 confirms the initial state of the third load 15, for example. In a case where the initial state is not normal, the control unit 30 restricts the start of the load that is not normal.

(Process in Regeneration Stopping State and Idle Reduction State)

Figure 24:
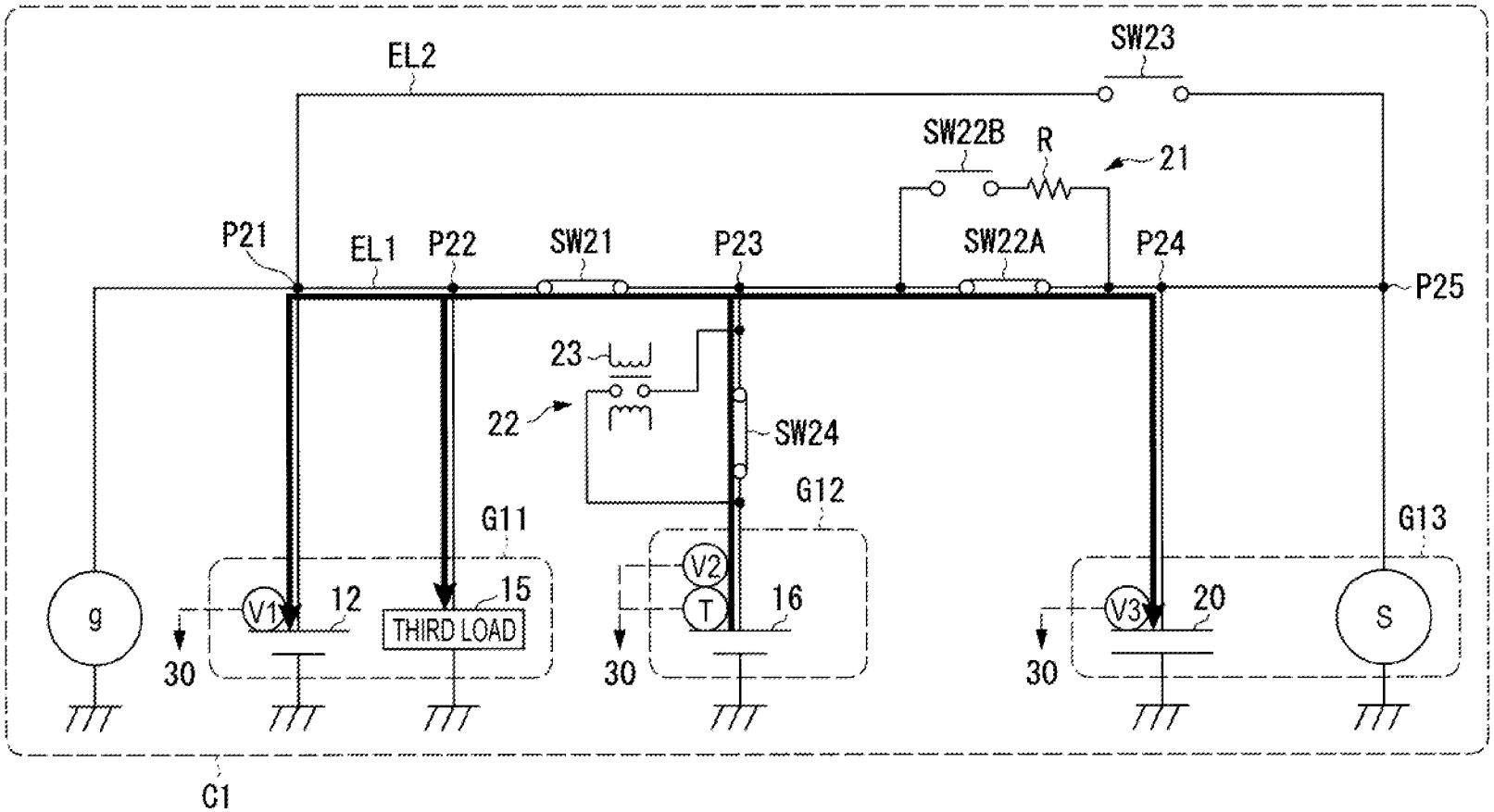
FIG. 24 is a diagram that illustrates a situation where the current is discharged from the second battery.

In a case where regeneration is stopped and where idling is stopped, the control unit 30 performs control to make the switch SW22B and the switch SW23 the OFF state, and performs control to make the switch SW21, the switch SW22A, and the switch SW24 the ON state, and causes the second battery 16 to actively discharge. FIG. 24 is a diagram that illustrates a situation where the current is discharged from the second battery 16. Because the electric potential of the second battery 16 is higher than the electric potential of the first battery 12, discharge is performed from the second battery 16, and discharge from the first battery 12 may be reduced.

(Process of Restarting after Idling is Stopped)

Figure 25:
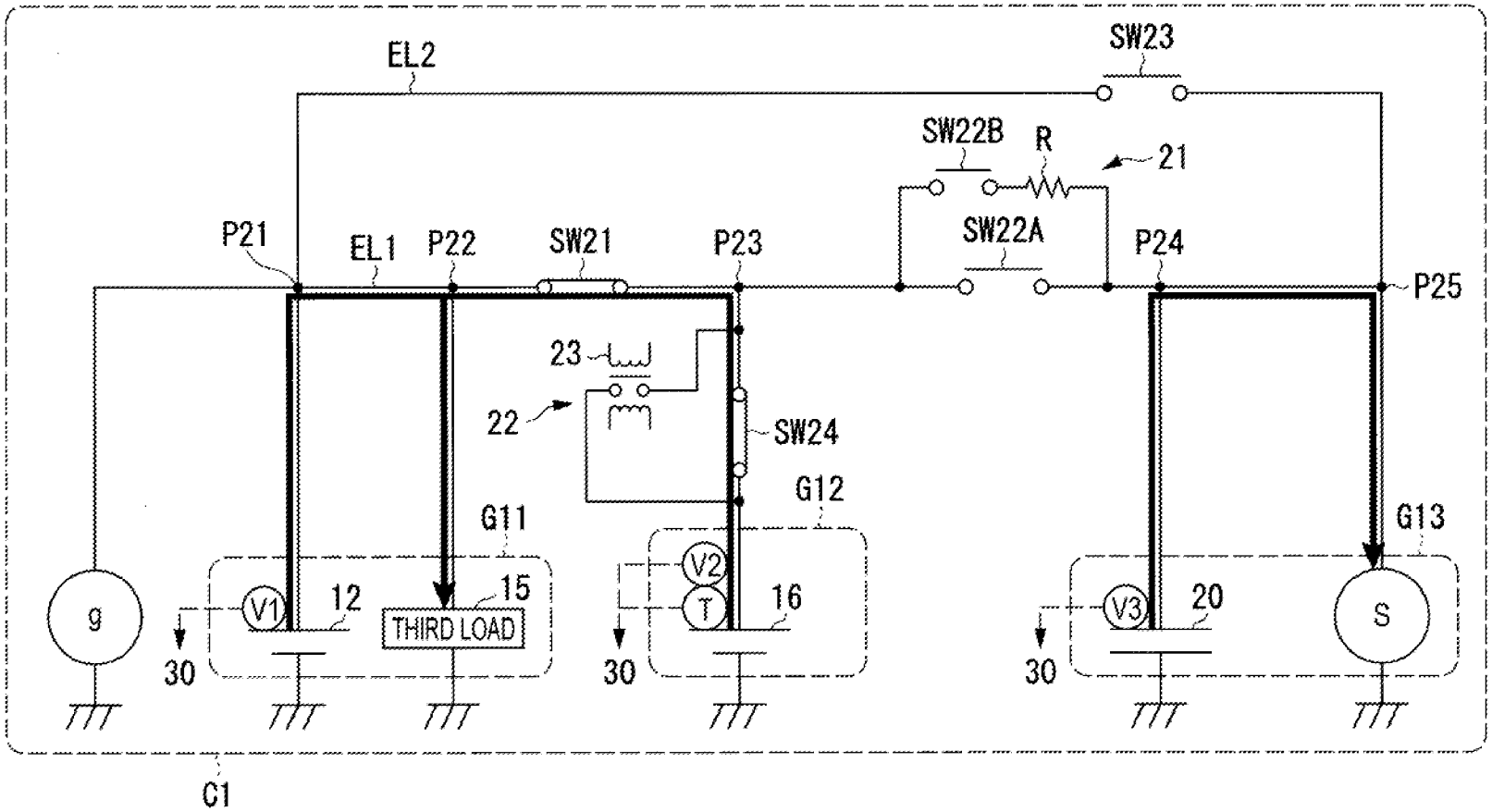
FIG. 25 is a diagram that illustrates a situation where the current is discharged from the capacitor in a case where the engine is restarted after idling is stopped.

In a case where a return request for restarting the engine E is made after idling is stopped, the control unit 30 performs control to make the switch SW22A, the switch SW22B, and the switch SW23 the OFF state, performs control to make the switch SW21 and the switch SW24 the ON state, supplies the current from the capacitor 20 to the starting device S, and thereby starts the starting device S. FIG. 25 is a diagram that illustrates a situation where the current is discharged from the capacitor 20 in a case where the engine E is restarted after idling is stopped. The control unit 30 starts the starting device S by using only the capacitor 20 and supplies the current from the first battery 12 and the second battery 16 to the third load 15. Accordingly, the control unit 30 may reduce a voltage fluctuation that occurs to the third load 15 when the starting device S starts. Further, even in a case where a defect occurs to the first battery 12 or the second battery 16, the current may be supplied from the first battery 12 or the second battery 16, to which no defect occurs, to the third load 15.

(Process in Case where Ignition Switch 40 is Turned Off after Travel)

Figure 26:
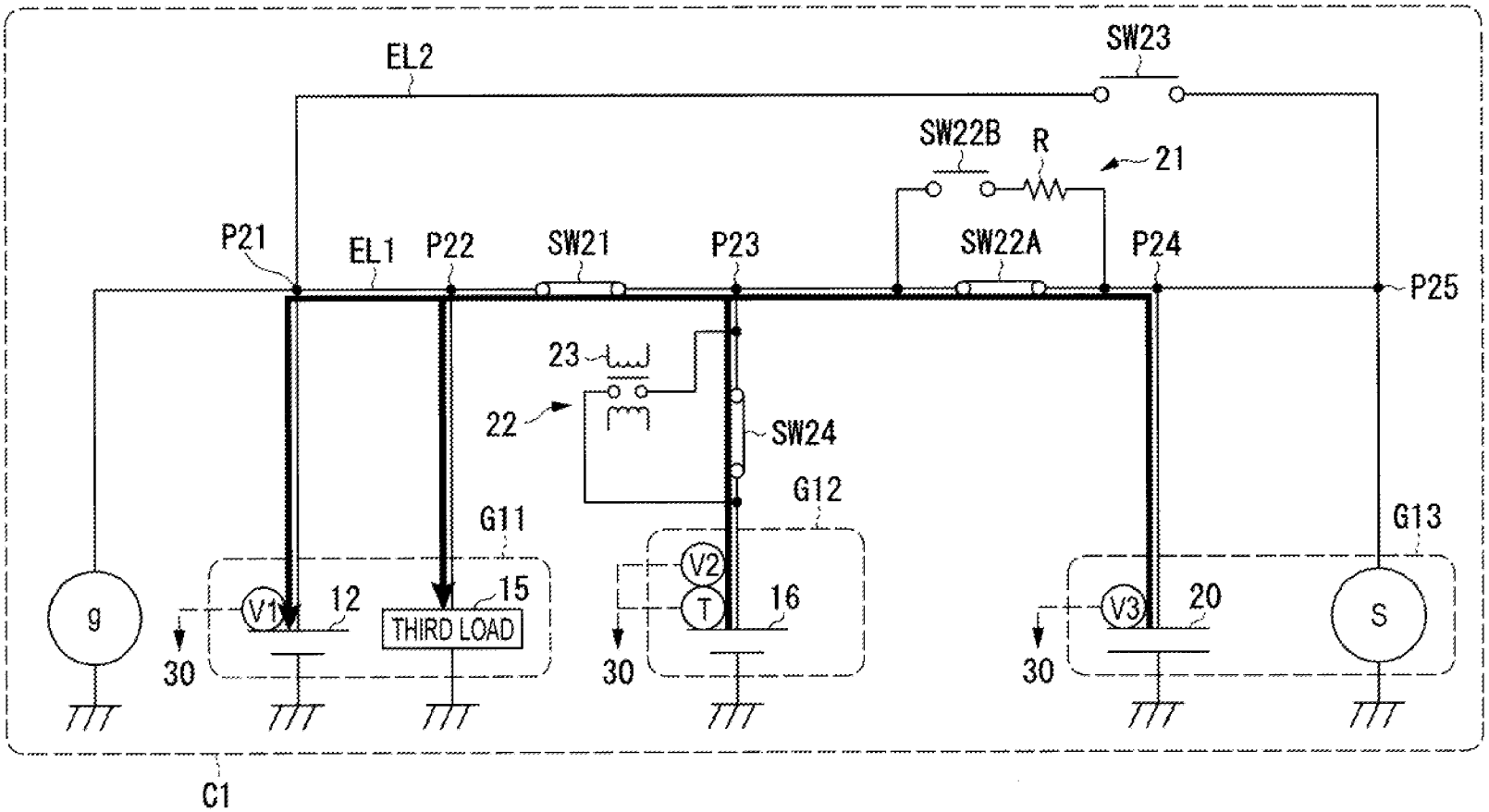
FIG. 26 is a diagram that illustrates a situation of a current flow in a case where the ignition switch is turned off after travel by using an output of the engine.

In a case where the ignition switch 40 is turned off after travel by using the output of the engine E, the control unit 30 performs control to make the switch SW22B and the switch SW23 the OFF state, performs control to make the switch SW21, the switch SW22A, and the switch SW24 the ON state, and supplies the current from the second battery 16 to the first battery 12 and the third load 15. FIG. 26 is a diagram that illustrates a situation of a current flow in a case where the ignition switch 40 is turned off after travel by using an output of the engine E. The illustrated example is based on an assumption that travel is performed in a state where self-discharge of the power accumulated in the first battery 12 occurs and the capacity decreases, and the ignition switch 40 is thereafter turned off in a state where the first battery 12 is not sufficiently charged, for example. In this case, because the control unit 30 supplies the current from the second battery 16 to the first battery 12, discharge of the current from the first battery 12 or the capacitor 20 may be reduced. As a result, deterioration (sulfation) of the first battery 12, deterioration of the capacitor 20, and so forth may be reduced.

As described above, the control unit 30 controls the switch SW21 to the switch SW24 in accordance with the operation state of the vehicle and thereby controls charge and discharge of the first battery 12, the second battery 16, and the capacitor 20. FIG. 27 illustrates one example of the relationship between vehicle states and control of the switches SW. In a case where the first battery 12 is deteriorated or where the capacity of the first battery 12 decreases and charge is necessary, control to make the switch SW21 to the switch SW24 the OFF state is performed. For example, in this state, an external power source is electrically connected with the first battery 12, and power may thereby be supplied from the external power source to the first battery 12.

The description is made on an assumption that the vehicle power source device 100 of the second embodiment includes the third load 15. However, the vehicle power source device 100 may include the first load 14 instead of the third load 15 and further have the second battery 16 connected with a joining point between the joining point P23 and the switch SW22A.

In the vehicle power source device 100 of the above-described second embodiment, when the engine E is started, the control unit 30 performs control to turn off the first switch SW21 that is provided between the first group G11, which includes the first battery 12 and the third load 15 connected with the first battery 12, and the second group G12, which includes the second battery 16, performs control to turn off the second switches SW22A and SW22B that are provided between the second group G12 and the third group G13, which includes the starting device S for starting the engine E and the capacitor 20, performs control to turn on the third switch SW23 that is provided between the first group G11 and the third group G13, and may thereby perform appropriate power control when the engine E is started.

In the foregoing, modes to carry out the techniques of the present disclosure have been described with the embodiments. However, the techniques of the present disclosure are not limited to such embodiments, but various modifications and replacement may be applied within the scope that does not depart from the gist of the present disclosure.

What is claimed is:

1. A vehicle power source device comprising:

an electrical circuit and components which comprise, a first group that comprises a first battery and a first load group which is connected with the first battery, a second group that comprises a second battery or comprises the second battery and a second load group which is connected with the second battery, a third group that comprises a starting device which starts an internal combustion engine of a vehicle and a capacitor, a first switch that is provided between the first group and the second group to connect or disconnect these groups, a second switch that is provided between the second group and the third group to connect or disconnect these groups, and a third switch that is provided between the first group and the third group to connect or disconnect these groups; and a controller configured to cause the starting device to start the internal combustion engine and configured to, when the starting device starts the internal combustion engine, perform the following control to: (i) turn the first switch off, thereby disconnecting the first group and the second group; (ii) turn the second switch off, thereby disconnecting the second group and the third group; and (iii) turn the third switch on, thereby connecting the first group and the third group.

2. The vehicle power source device according to claim 1, wherein the second load group comprises an in-vehicle apparatus which requires a longer period of time to be activated than the first load group, an in-vehicle apparatus which is required for a driving operation of the vehicle, or a processor that controls the in-vehicle apparatus required for the driving operation.

3. The vehicle power source device according to claim 1, further comprising:

a fourth switch that is provided between the second battery and the second load group to connect or disconnect the second battery and the second load group; and a fifth switch that is provided between the capacitor and the starting device to connect or disconnect the capacitor and the starting device, wherein the controller is further configured to temporarily stop the internal combustion engine and later restart the internal combustion engine in accordance with a predetermined condition, the controller being configured to, when the internal combustion engine is restarted, perform the following control to: turn the first switch on; the second switch off; the third switch off; the fourth switch on, thereby connecting the second battery and the second load group; and the fifth switch on, thereby connecting the capacitor and the starting device.

4. The vehicle power source device according to claim 3, wherein the controller performs control to turn the first switch on, the second switch on, the third switch off, the fourth switch on, and the fifth switch when the internal combustion engine is being temporarily stopped.

5. The vehicle power source device according to claim 3, wherein the controller is further configured to cause a generator of the vehicle to output regenerative power and to, when the generator outputs the regenerative power, perform the following control to turn the first switch on, the second switch on, the third switch off, the fourth switch on, and the fifth switch on.

6. The vehicle power source device according to claim 3, wherein the controller is further configured to start or stop the internal combustion engine upon receiving a signal from an ignition switch of the vehicle and configured to, upon receiving the signal from the ignition switch to stop the internal combustion engine, perform the following control to turn the first switch on, the second switch on, the third switch off, the fourth switch on, and the fifth switch on.

7. The vehicle power source device according to claim 3, wherein the controller performs the following control to turn the first switch on, the second switch on, the third switch off, the fourth switch on, and the fifth switch off, when the capacitor is being charged.

8. The vehicle power source device according to claim 3, wherein the controller is further configured to detect abnormality of the capacitor and to, when it detects the abnormality of the capacitor, perform the following control to turn the first switch on, the second switch on, the third switch off, the fourth switch on, and the fifth switch off.

9. The vehicle power source device according to claim 3, wherein the controller is further configured to defect abnormality of the second battery and to, when it detects the abnormality of the second battery, perform the following control to turn the first switch on, the second switch on, the third switch off, the fourth switch off, and the fifth switch on.

10. The vehicle power source device according to claim 1, further comprising:

a fourth switch that is provided between the second battery and the first and second switches to connect or disconnect the second battery and the first and second switches, wherein the controller is further configured to temporarily stop the internal combustion engine and later restart the internal combustion engine in accordance with a predetermined condition, the controller being configured to, when the internal combustion engine is restarted, perform the following control to turn the first switch on, the second switch off, the third switch off, and the fourth switch on.

11. The vehicle power source device according to claim 1, wherein the controller performs the following control to turn the first switch on, the second switch on, the third switch off, and the fourth switch when the internal combustion engine is being temporarily stopped.

12. The vehicle power source device according to claim 1, wherein the controller is further configured to cause a generator of the vehicle to output regenerative power and to, when the generator outputs the regenerative power, perform the following control to turn the first switch on, the second switch on, the third switch off, and the fourth switch on.

13. The vehicle power source device according to claim 1, wherein the controller is further configured to start or stop the internal combustion engine upon receiving a signal from an ignition switch of the vehicle and configured to, upon receiving the signal from the ignition switch to stop the internal combustion engine, perform the following control to turn the first switch on, the second switch on, the third switch off, and the fourth switch on.

14. The vehicle power source device according to claim 1, wherein the controller performs the following control to turn the first switch on, the second switch on, and the third switch off when the capacitor is being charged.

* * * * *